US007347495B2

(12) United States Patent
Beyer et al.

(10) Patent No.: US 7,347,495 B2
(45) Date of Patent: Mar. 25, 2008

(54) CHAIR BACK WITH LUMBAR AND PELVIC SUPPORTS

(75) Inventors: Pete J. Beyer, Hamilton, MI (US); Joe Willette, Grand Haven, MI (US); Larry A. Wilkerson, Comstock Park, MI (US); Teresa Bellingar, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/598,164

(22) Filed: Nov. 10, 2006

(65) Prior Publication Data

US 2007/0057550 A1 Mar. 15, 2007

Related U.S. Application Data

(63) Continuation of application No. PCT/US2006/007822, filed on Mar. 1, 2006.

(60) Provisional application No. 60/657,312, filed on Mar. 1, 2005.

(51) Int. Cl.
*A47C 7/14* (2006.01)

(52) U.S. Cl. ..... 297/284.3; 297/284.4; 297/284.5

(58) Field of Classification Search ..... 297/284.4, 297/284.3, 284.5
See application file for complete search history.

(56) References Cited

U.S. PATENT DOCUMENTS

| | | | |
|---|---|---|---|
| 889,224 | A | 6/1908 | Haas |
| 2,991,124 | A | 7/1961 | Schwarz |
| 3,008,764 | A | 11/1961 | Pile |
| 3,081,129 | A | 3/1963 | Ridder |
| 3,121,592 | A | 2/1964 | Anderson |
| 3,288,525 | A | 11/1966 | Cerf |
| 3,938,858 | A | 2/1976 | Drabert et al. |
| 3,948,558 | A | 4/1976 | Obermeier et al. |
| 3,973,797 | A | 8/1976 | Obermeier et al. |
| 4,019,777 | A | 4/1977 | Hayashi |
| 4,155,592 | A | 5/1979 | Tsuda et al. |
| 4,309,058 | A | 1/1982 | Barley |
| 4,451,085 | A | 5/1984 | Franck et al. |
| 4,465,317 | A | 8/1984 | Schwarz |
| 4,502,728 | A | 3/1985 | Sheldon et al. |
| 4,564,235 | A | 1/1986 | Hatsutta et al. |
| 4,585,272 | A | 4/1986 | Ballarini |
| 4,722,569 | A | 2/1988 | Morgenstern et al. |
| 4,728,148 | A | 3/1988 | Saito |
| 4,730,871 | A | 3/1988 | Sheldon |

(Continued)

FOREIGN PATENT DOCUMENTS

| | | |
|---|---|---|
| EP | 0 296 938 B1 | 6/1991 |

(Continued)

*Primary Examiner*—Anthony D. Barfield
(74) *Attorney, Agent, or Firm*—Flynn, Thiel, Boutell & Tanis, P.C.

(57) ABSTRACT

An office chair is provided having a back assembly which is configured to provide supplemental support to the back of a chair occupant in addition to the support provided by the primary support surface of the chair back. The chair back includes a lumbar support unit having a lumbar support pad wherein asymmetric support is provided to the left and right halves of the lumbar pad. As such, the asymmetric support loads are independently adjustable to more comfortably support a chair occupant. The chair back also includes a pelvic support pad which is disposed vertically adjacent to the lumbar support.

37 Claims, 20 Drawing Sheets

U.S. PATENT DOCUMENTS

| | | | |
|---|---|---|---|
| 4,744,351 | A | 5/1988 | Grundei et al. |
| 4,981,325 | A | 1/1991 | Zacharkow |
| 4,981,326 | A | 1/1991 | Heidmann |
| 4,993,164 | A | 2/1991 | Jacobsen |
| 5,011,223 | A | 4/1991 | Kato |
| 5,054,854 | A | 10/1991 | Pruit |
| 5,120,109 | A | 6/1992 | Rangoni |
| 5,195,801 | A | 3/1993 | Franck et al. |
| 5,215,350 | A | 6/1993 | Kato |
| 5,249,839 | A | 10/1993 | Faiks et al. |
| 5,385,388 | A | 1/1995 | Faiks et al. |
| 5,466,045 | A | 11/1995 | Akima |
| 5,501,507 | A | 3/1996 | Hummitzsch |
| 5,505,520 | A | 4/1996 | Frusti et al. |
| 5,507,559 | A | 4/1996 | Lance |
| 5,582,459 | A | 12/1996 | Hama et al. |
| 5,704,688 | A | 1/1998 | Schrewe et al. |
| 5,704,689 | A | 1/1998 | Kim |
| 5,718,476 | A | 2/1998 | DePascal et al. |
| 5,791,733 | A | 8/1998 | van Hekken et al. |
| 5,797,652 | A | 8/1998 | Darbyshire |
| 5,806,931 | A | 9/1998 | Kogai |
| 5,826,940 | A | 10/1998 | Hodgdon |
| 5,957,533 | A | 9/1999 | Gallardo |
| 6,039,397 | A | 3/2000 | Ginat |
| 6,056,361 | A | 5/2000 | Cvek |
| 6,079,785 | A | 6/2000 | Peterson et al. |
| 6,092,871 | A | 7/2000 | Beaulieu |
| 6,116,687 | A | 9/2000 | Vogtherr |
| 6,189,972 | B1 | 2/2001 | Chu et al. |
| 6,217,121 | B1 | 4/2001 | Mollet |
| 6,257,665 | B1 | 7/2001 | Nagamitsu et al. |
| 6,260,921 | B1 | 7/2001 | Chu et al. |
| 6,261,213 | B1 | 7/2001 | Frey |
| 6,354,662 | B1 | 3/2002 | Su |
| 6,378,942 | B1 | 4/2002 | Chu |
| 6,394,545 | B2 | 5/2002 | Knoblock et al. |
| 6,394,546 | B1 | 5/2002 | Knoblock et al. |
| 6,409,268 | B1 | 6/2002 | Cvek |
| 6,412,868 | B1 | 7/2002 | Küster et al. |
| 6,460,928 | B2 | 10/2002 | Knoblock et al. |
| 6,471,294 | B1 | 10/2002 | Dammermann et al. |
| 6,523,898 | B1 | 2/2003 | Ball et al. |
| 6,530,622 | B1 | 3/2003 | Ekern et al. |
| 6,536,841 | B1 | 3/2003 | Pearce et al. |
| 6,557,938 | B1 | 5/2003 | Long |
| 6,568,760 | B2 | 5/2003 | Davis et al. |
| 6,572,190 | B2 | 6/2003 | Koepke et al. |
| 6,588,842 | B2 | 7/2003 | Stumpf et al. |
| 6,595,585 | B2 | 7/2003 | Mundell |
| 6,616,228 | B2 | 9/2003 | Heidmann |
| 6,619,739 | B2 | 9/2003 | McMillen |
| 6,623,076 | B2 | 9/2003 | Klingler |
| 6,637,817 | B1 | 10/2003 | Christopher et al. |
| 6,644,740 | B2 | 11/2003 | Holst et al. |
| 6,666,511 | B2 | 12/2003 | Schuster et al. |
| 6,814,407 | B2 | 11/2004 | Mundell |
| 6,820,933 | B2 | 11/2004 | DaSilva |
| 6,874,852 | B2 | 4/2005 | Footitt |
| 6,918,633 | B2 * | 7/2005 | Forkel et al. ..... 297/284.4 X |
| 7,000,986 | B2 | 2/2006 | DePinho |
| 2003/0075959 | A1 | 4/2003 | Xue |
| 2005/0062323 | A1 | 3/2005 | Dicks |

FOREIGN PATENT DOCUMENTS

| | | | |
|---|---|---|---|
| EP | 0 518 830 | A1 | 12/1992 |
| EP | 0 540 481 | A1 | 5/1993 |
| EP | 0 420 824 | B1 | 1/1994 |
| EP | 0 563 709 | B1 | 10/1996 |
| WO | WO94/25307 | | 11/1994 |
| WO | WO03/063651 | A2 | 8/2003 |

* cited by examiner

FIG. 14
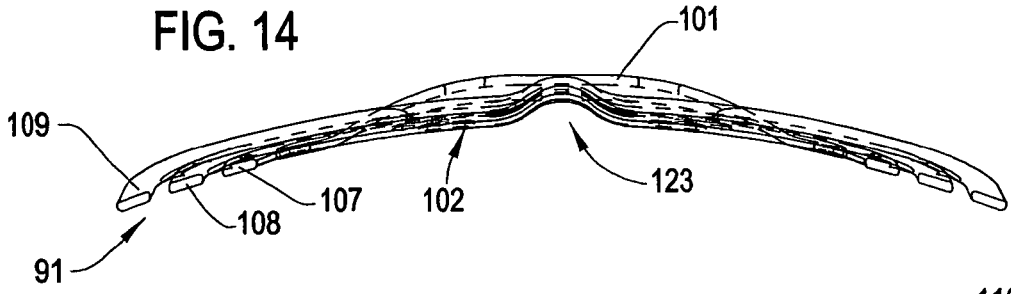
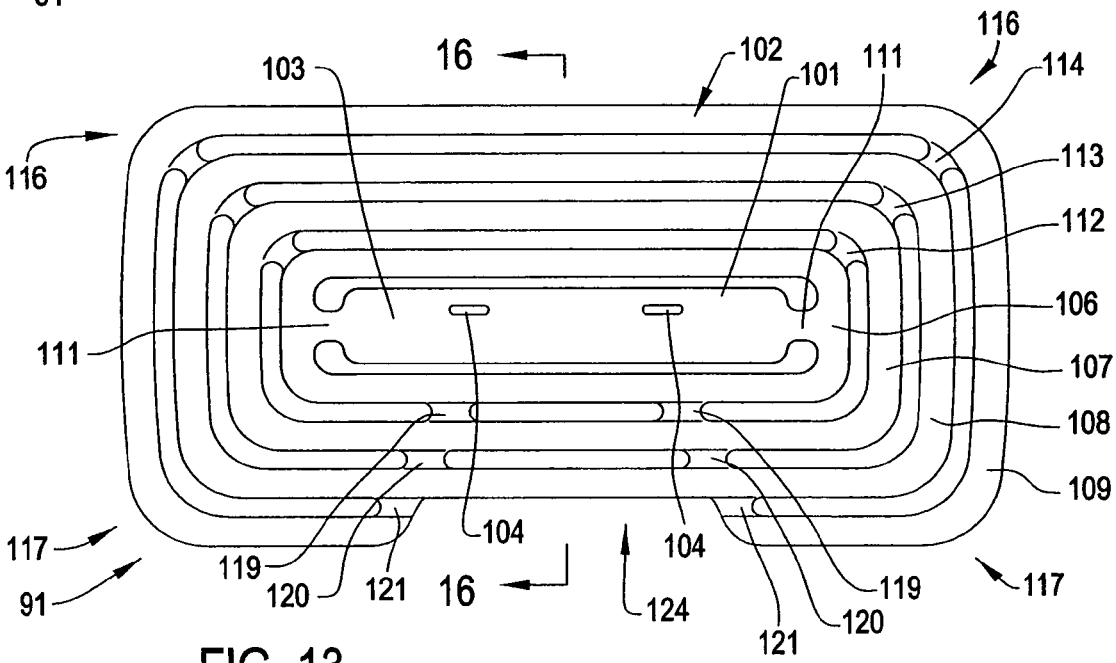
FIG. 13
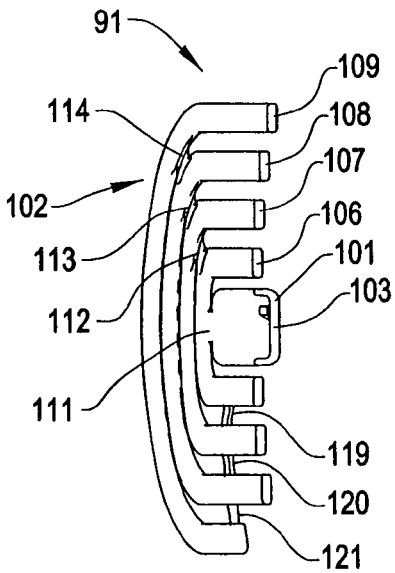
FIG. 15
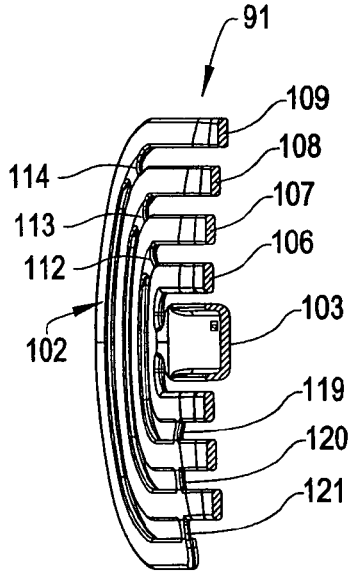
FIG. 16

CHAIR BACK WITH LUMBAR AND PELVIC SUPPORTS

CROSS REFERENCE TO RELATED APPLICATION

This application is a continuation of PCT Application No. PCT/US06/07822, filed Mar. 1, 2006, which claims the benefit of U.S. Provisional Application No. 60/657,312, filed Mar. 1, 2005.

FIELD OF THE INVENTION

The invention relates to an office chair and more particularly, to an office chair having lumbar and pelvic supports to support the back of the chair occupant.

BACKGROUND OF THE INVENTION

Preferably, conventional office chairs are designed to provide significant levels of comfort and adjustability. Such chairs typically include a base which supports a tilt control mechanism to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assembly so that they may tilt rearwardly together in response to movements by the chair occupant, and possibly to permit limited forward tilting of the seat and back. Further, such chairs typically permit the back to also move relative to the seat during such rearward tilting.

The chair also is designed to provide additional support assemblies to provide further support to the occupant's body at various locations thereof. In this regard, support assemblies have been provided which attempt to provide adjustable support to the lower back of the user in the lumber region thereof. However, one difficulty associated with the design of conventional office chairs is the fact that office workers have different physical characteristics and comfort preferences such that it is difficult to design a single chair configuration that satisfies the preferences of the different individuals who might purchase such a chair.

To improve comfort, it is known to provide lumbar supports which allow for adjustment of the elevation of the lumbar support along the back of the user. However, often times, such lumbar supports may be found uncomfortable to various individuals since they tend to provide localized pressure on the lumbar region of the back.

Accordingly, it is an object of the invention to overcome disadvantages associated with prior lumbar support arrangements.

The invention relates to a chair having an improved back assembly which provides support to the lumbar region of the chair occupant as well as to the pelvic region thereof. The back assembly of the invention includes a lumbar support arrangement disposed in the lumbar region of the back which is adjustable vertically to accommodate different sizes of chair users. Also, a pelvic support unit, i.e. pusher, may be provided vertically below the lumbar support to gently press upon the back of the user in the pelvic region thereof.

The back assembly is of the type having an open annular frame with a suspension fabric extending therebetween to close the central opening of the back frame. Since this suspension fabric is only a thin layer of material, the support provided by the lumbar support assembly is more readily felt and it is more critical to provide a comfortable lumbar support pad.

In an effort to provide optimum support to the back of the chair occupant, the lumbar support pad itself is formed of concentric support rings wherein radially adjacent pairs of such rings are flexibly joined together by connector webs extending therebetween. To a certain extent, each ring can independently move relative to an adjacent ring such that an outer ring would first contact an occupant and a next linear ring would then successively support the occupant as the occupant deflects the pad. This allows for greater variations in pressure being applied by each ring to the back of the user. Further, the lumbar support pad more readily adjusts to the shape of the occupant's back if the occupant presses sufficiently against the pad. The lumbar support thereby provides a desired amount of support while maintaining a proper ergonomic posture which does not depend upon movement of a lumbar pad toward or away from an occupant as in some prior art lumbar supports.

Additionally, the lumbar support pad is carried by a support arm formed similar to a leaf spring wherein the support arm has a vertically elongate opening in the middle thereof to separate the left and right halves of the support arm from each other along a substantial portion of the length of each support arm. While the support arm may bend rearwardly in response to the occupant, the bending point or fulcrum point for each of the left and right arm halves is independently adjustable so that the support provided to the lumbar support pad is asymmetric with respect to the left and right halves of the support pad. This support arm provides asymmetric support to the lumbar support pad and each half thereof may move more independently of the other in response to different loads or if remaining stationary, generate variable, asymmetric counter-pressure to the occupant which resists movement of the pad. The lumbar support arm provides varying rates of support for a given amount of deflection by repositioning the fulcrum point. The asymmetric support of the lumbar is adjustable by a pair of adjustment cranks which rotate independently of each other to adjust the fulcrum point of the respective arm halves without requiring or causing displacement of the pad. The chair occupant therefore can more accurately adjust the support provided by the support pad asymmetrically wherein it has been found that this asymmetric support provides improved comfort to the chair occupant.

Additionally, the pelvic support is provided vertically adjacent to the lumbar support to provide support to the different regions of the occupant's back. As described in further detail herein, the foregoing arrangement of a back assembly provides a more comfortable system for supporting the occupant's back.

Other objects and purposes of the invention, and variations thereof, will be apparent upon reading the following specification and inspecting the accompanying drawings.

BRIEF DESCRIPTION OF THE DRAWINGS

FIG. 13 is a front view of the lumbar pad.

FIG. 14 is a top view of the lumbar pad.

FIG. 15 is a side view of the lumbar pad.

FIG. 16 is a side cross-sectional view of the lumbar pad as taken along line 16-16 of FIG. 13.

Figure 2:
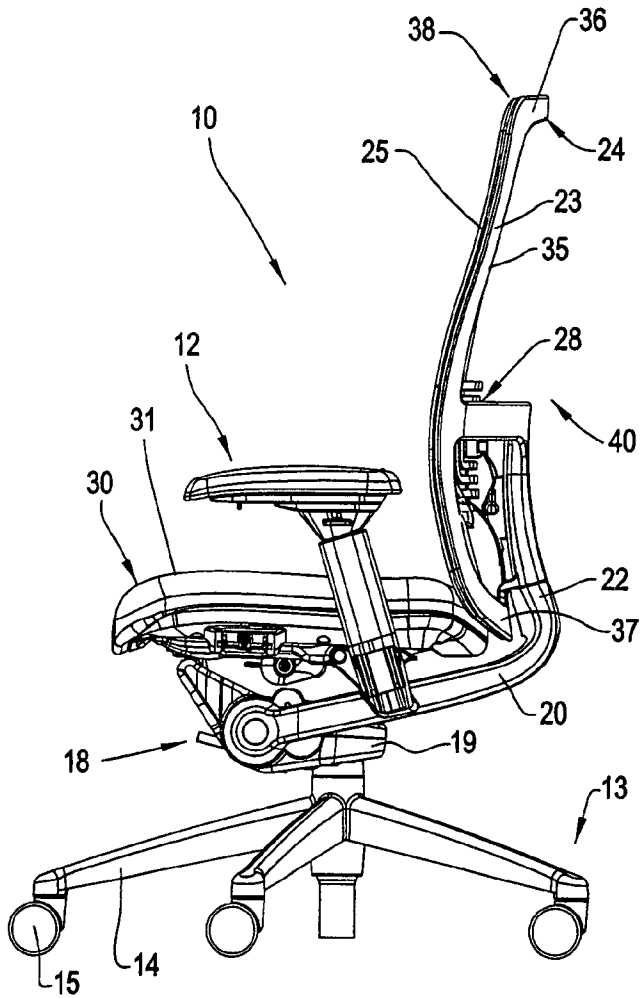
FIG. 2 is a side elevational view thereof.
Figure 1:
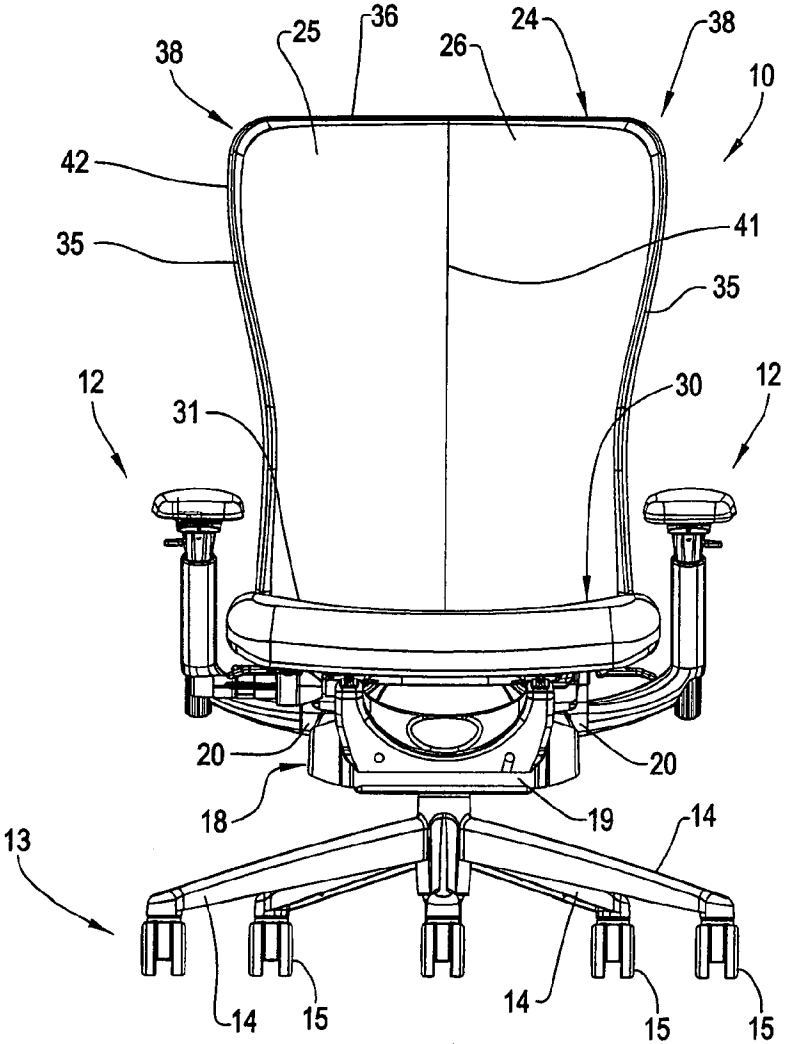
FIG. 1 is a front elevational view of an office chair of the invention.
Figure 4:
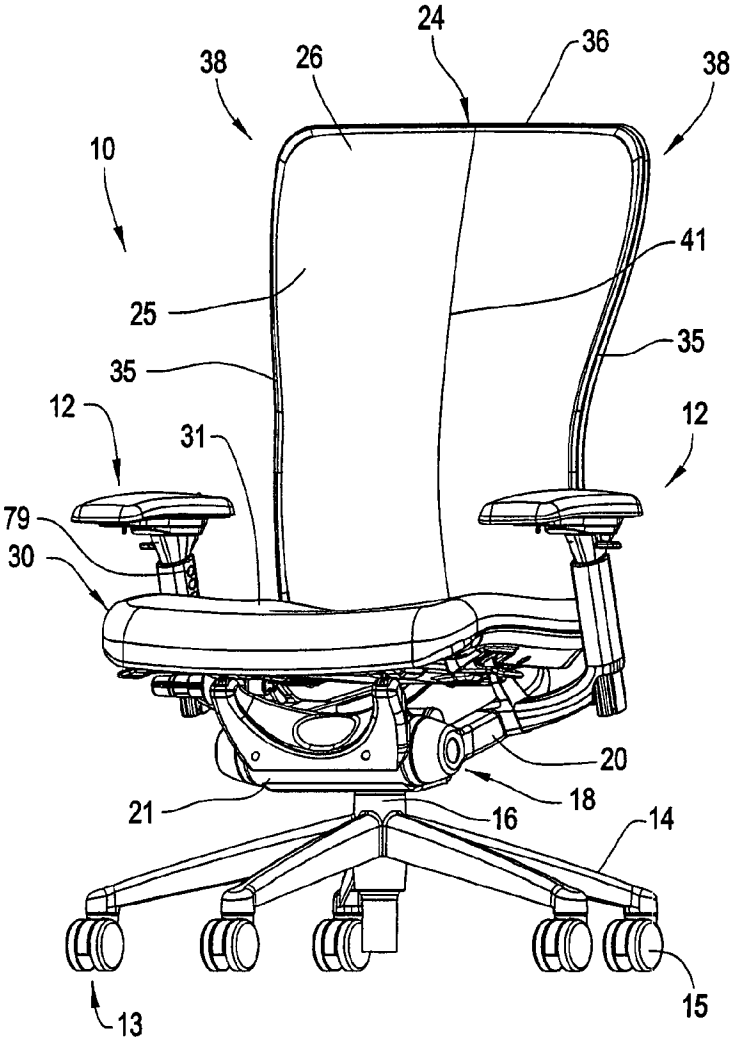
FIG. 4 is a front isometric view of the chair.
Figure 3:
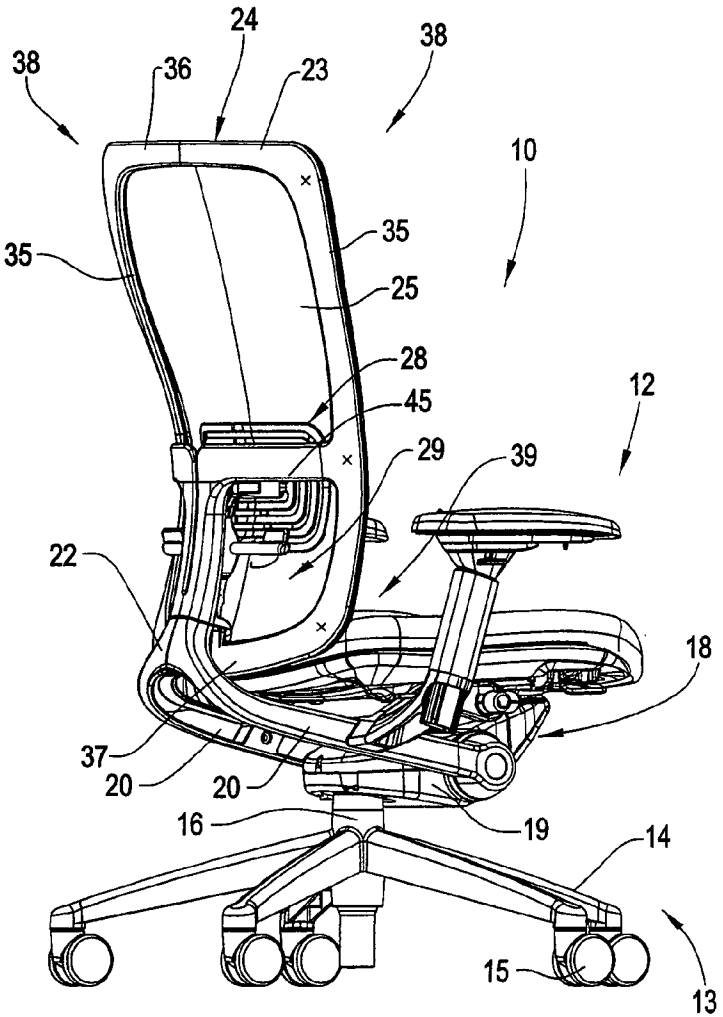
FIG. 3 is a rear isometric view thereof illustrating lumbar and pelvic support units therefor.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein which accommodate the different physical characteristics and comfort preferences of a chair occupant and also improve assembly of the chair 10.

Generally, this chair 10 includes improved height-adjustable arm assemblies 12 which are readily adjustable. The structure of each arm assembly 12 is disclosed in U.S. Provisional Patent Application Ser. No. 60/657,632, filed Mar. 1, 2005, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 13 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 20 converge rearwardly together to define a connector hub 22 (FIG. 3) on which is supported the back frame 23 of a back assembly 24. The structure of this tilt control mechanism 18 is disclosed in U.S. Provisional Patent Application Ser. Nos. 60/657,541, filed Mar. 1, 2005, and 60/689,723, filed Jun. 10, 2005, both entitled TILT CONTROL MECHANISM FOR A CHAIR, and U.S. Provisional Patent Application Ser. No. 60/657,524, filed Mar. 1, 2005, entitled TENSION ADJUSTMENT MECHANISM FOR A CHAIR, which applications are owned by Haworth, Inc. The disclosure of each of these patent applications is incorporated herein in their entirety by reference.

The back assembly 24 has a suspension fabric 25 supported about its periphery on the corresponding periphery of the frame 23 to define a suspension surface 26 against which the back of a chair occupant is supported. The structure of the back assembly 24 is disclosed in U.S. Provisional Patent Application Ser. No. 60/657,313, filed Mar. 1, 2005, entitled CHAIR BACK, which is owned by Haworth, Inc. The disclosure of this patent application is incorporated herein in its entirety by reference.

To provide additional support to the occupant, the back assembly 24 includes a lumbar support unit 28 which is configured to support the lumbar region of the occupant's back and is adjustable to improve the comfort of this support. Also, the back assembly 24 is provided with a pelvic support unit 29 disposed rearwardly of the pelvic region of the chair occupant.

Additionally, the chair 10 includes a seat assembly 30 that defines an upward facing support surface 31 on which the seat of the occupant is supported.

Turning first to the back assembly 24 which supports the lumbar support unit 28 and the pelvic support unit 29, the back assembly 24 is generally illustrated in FIGS. 5-8 wherein the back frame 23 comprises a pair of vertical side frame rails 35, a top frame rail 36, and a bottom frame rail 37 which are joined together at the upper corners 38 of the back assembly 24 as well as the lower corners 39 to define an annular or endless frame having a central opening 40.

Figure 5:
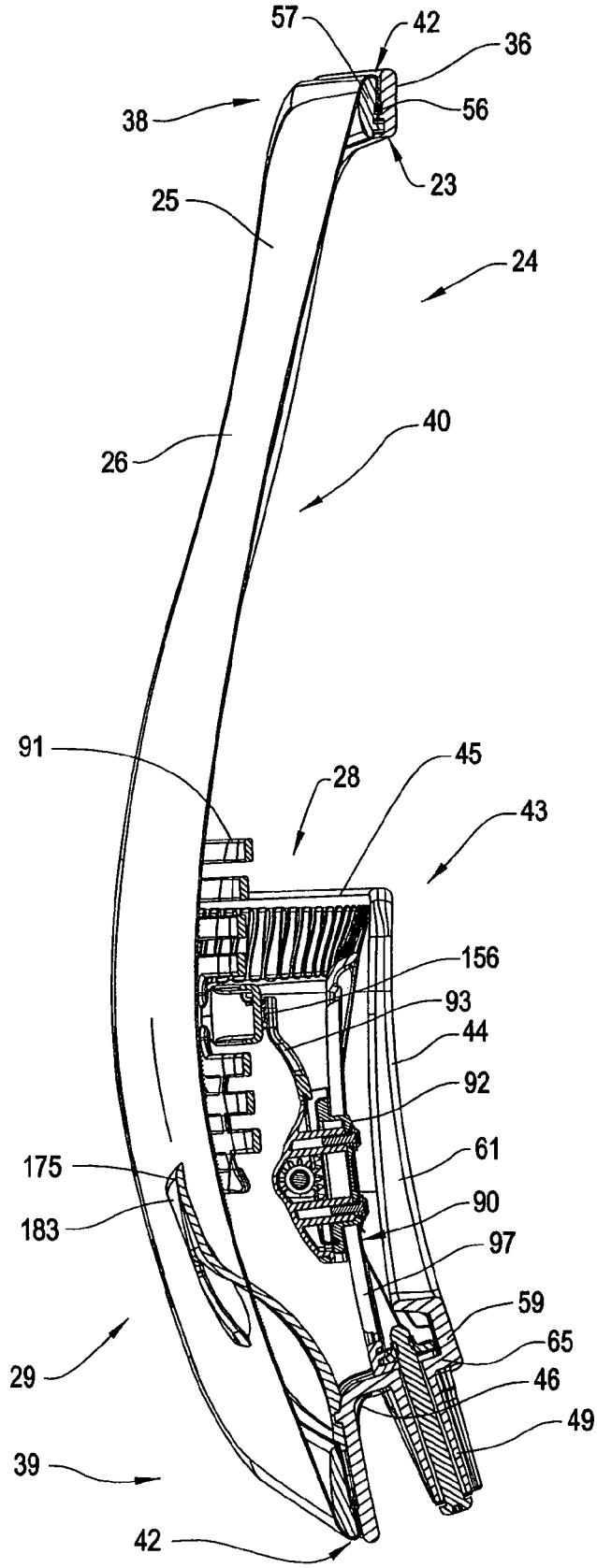
FIG. 5 is a side cross-sectional view of a chair back assembly illustrating the lumbar and pelvic support units.
Figure 6:
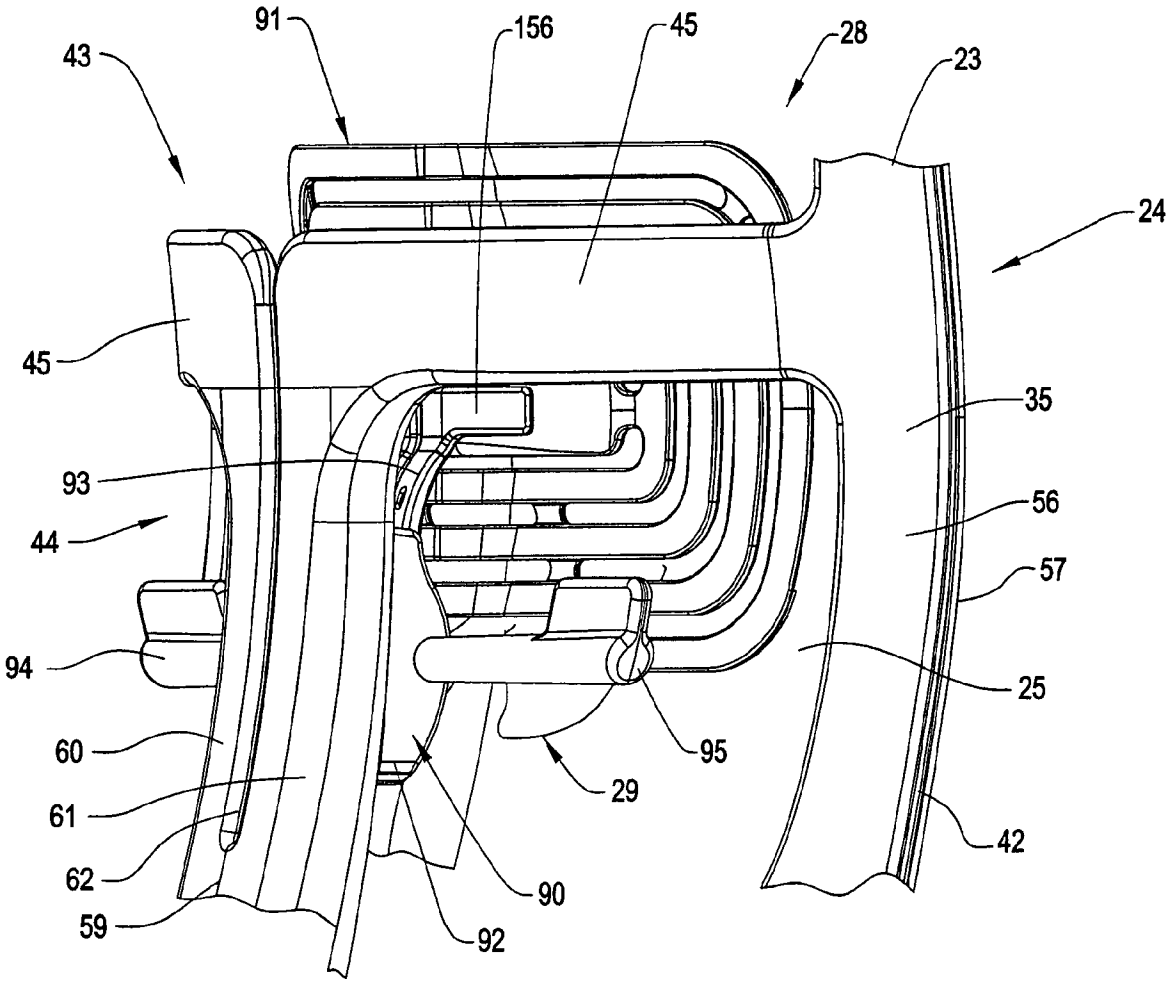
FIG. 6 is an enlarged rear isometric view of the back assembly.
Figure 7:
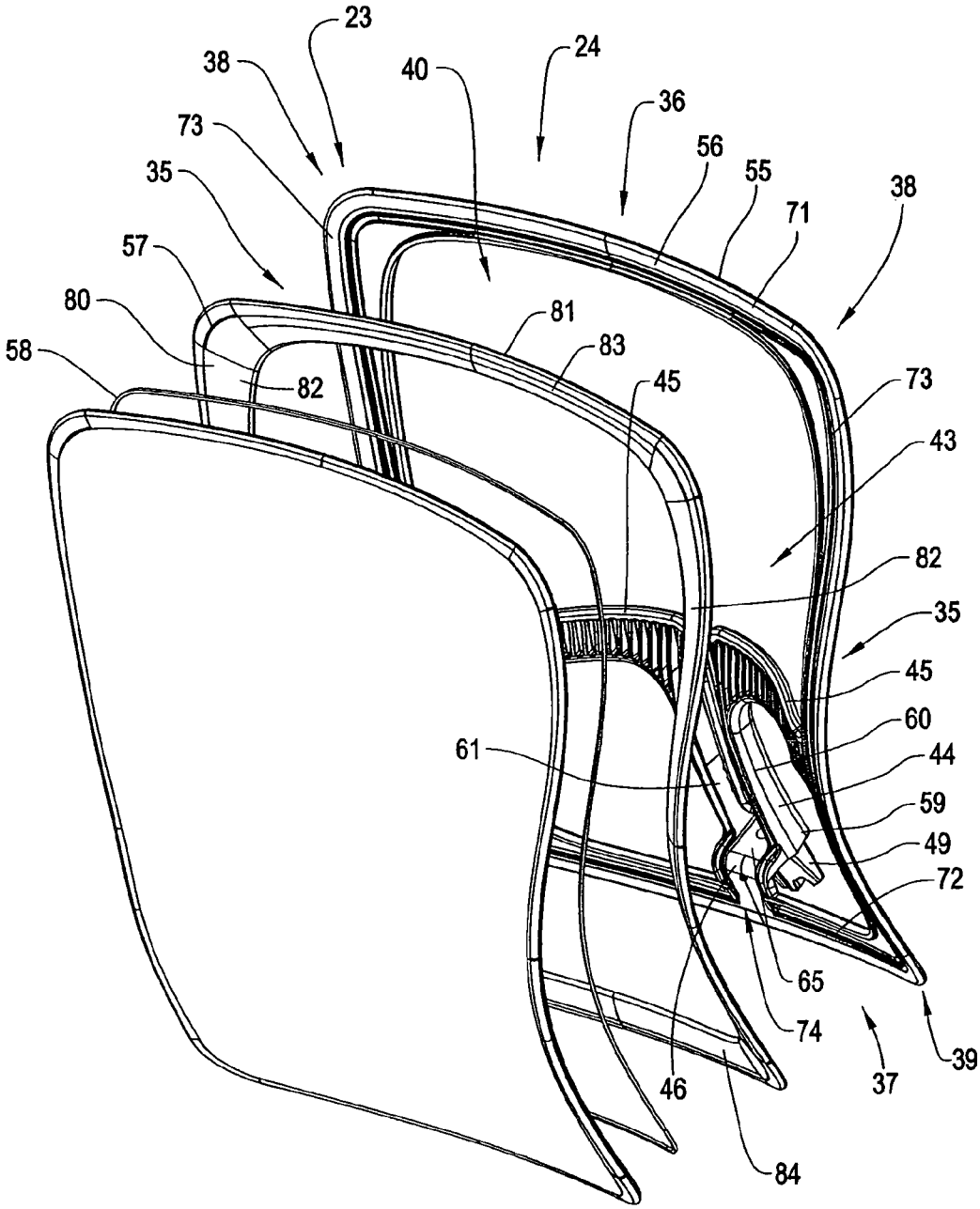
FIG. 7 is an exploded isometric view of the back frame for the back assembly.

As can be seen in FIGS. 5-7, the back frame 23 has a contoured shape which ergonomically supports the back of the occupant. In particular, the side rails 35 curve backwardly as seen in FIGS. 2 and 5 as well as outwardly (FIG. 1) relative to the bottom portions of the side rails 35. Further, the top rail 36 and bottom rail 37 each have a respective curvature to closely conform to the curvature of a typical chair occupant.

To support the occupant, the back assembly 24 includes the suspension fabric 25 which is secured taughtly on the frame. Specifically, the back frame 23 includes a peripheral spline channel 42 (FIGS. 1, 5 and 6), in which is fixed the peripheral edge of the suspension fabric 25.

Referring further to FIGS. 5-7, the back frame 23 generally includes a support structure 43 to which the side rails 35 and bottom rail 37 are rigidly interconnected. This support structure 43 comprises an upright support column 44 which extends along the chair center line 41 (FIG. 1) to an elevation located just below the middle of the side rails 35. The upper end of the support column includes a pair of horizontal support arms 45 which extend sidewardly and have each respective outer end connected rigidly to one of the side rails 35.

The lower end of the support column 44 includes a generally L-shaped connector flange 46 (FIGS. 5 and 7) which projects forwardly and then downwardly into fixed engagement with the lower cross rail 37. Still further, this lower column end includes a bayonet connector 49 which projects downwardly for rigid connection to the uprights 20 by fastener bolt 50 (FIG. 8) and nut 51.

Figure 8:
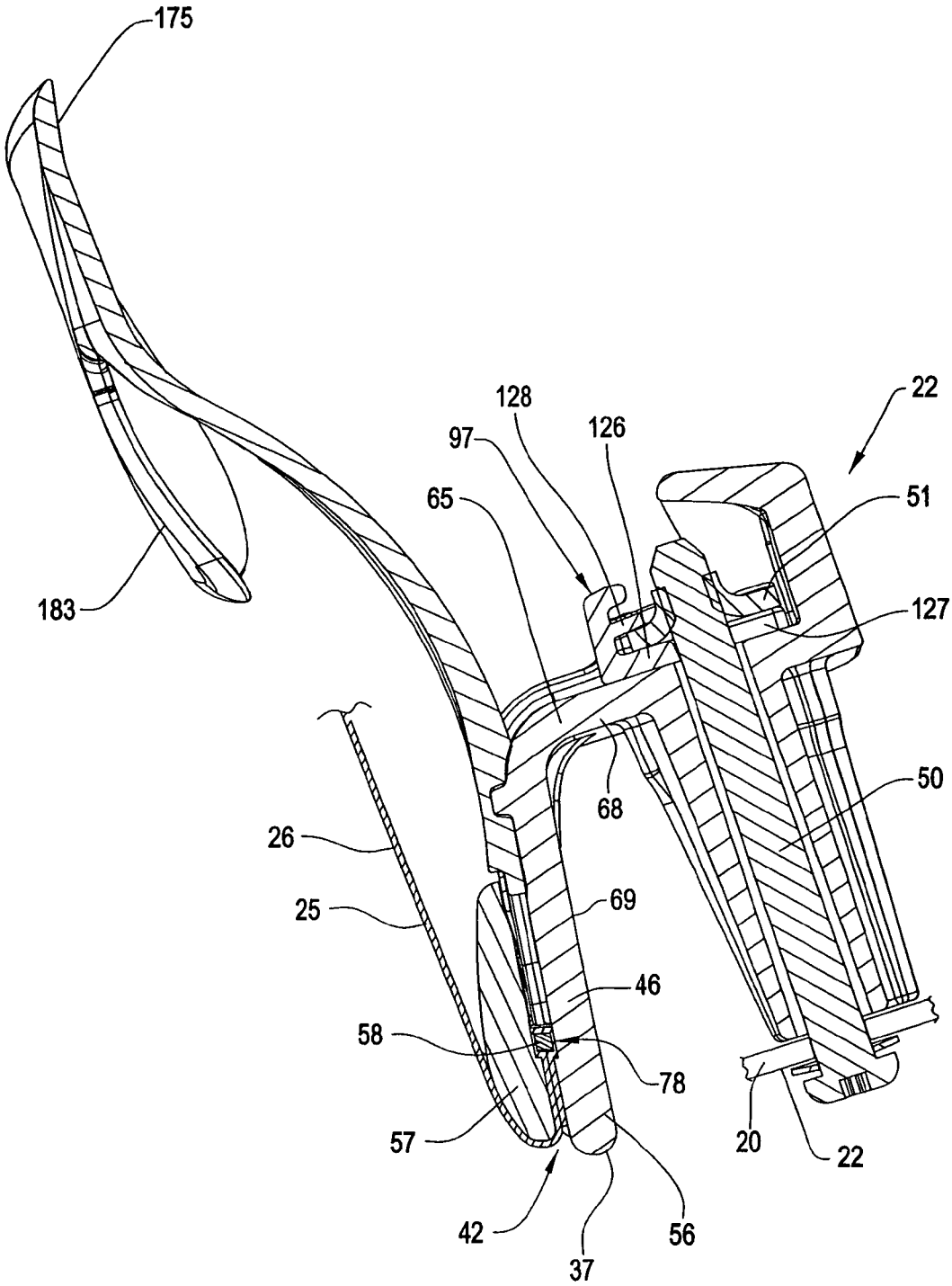
FIG. 8 is an enlarged side cross-sectional view of a bayonet connector arrangement for mounting the back assembly to a tilt control mechanism with the pelvic support unit or pusher illustrated therein.

Referring more particularly to the components of the back assembly 24, FIG. 7 illustrates these components in an exploded view thereof, wherein the frame 23 comprises a rear frame unit 55 which includes the support structure 43 described above as well as a rear frame ring 56 which is supported on the support arms 45 of the support structure 44. The back frame 24 further comprises a front frame ring 57 which is adapted to be mounted to the rear ring 56 in overlying relation to define the spline channel 42 about the periphery thereof. Further, the back assembly 24 includes the above-described suspension fabric 25 and an elastomeric spline 58 (FIGS. 7 and 8).

The rear frame unit 55 comprises the support structure 43 and the rear frame ring 56, wherein the support structure 43 and the rear frame ring 56 are molded simultaneously together in a one-piece monolithic construction having the contoured shape described above. To facilitate molding of this contoured shape while still possessing the spline channel 42 mentioned above, the rear frame ring 56 and front frame ring 57 are molded separate from each other and then affixed together.

Turning to the support structure 43, the support column 44 thereof is located centrally within the lower half of the central frame opening 40. The support column 44 has a base end 59 and a pair of column halves 60 and 61 which are separated from each other by a vertically elongate column slot 62. The column 44 therefore is formed as a split column by the slot 62 which extends along a substantial portion of the length of the column 44 with the column halves 60 and 61 being formed as one piece along with the base section 59. As such, the column halves 60 and 61 are supported in cantilevered relation by the base section 59.

The rear frame unit 55 and front frame ring 57 are formed from a glass filled nylon material that is molded into the desired shapes wherein this material has limited flexure so as to permit flexing of the various areas of the frame when placed under load by a chair occupant. Since the column halves 60 and 61 are separated from each other, these column halves 60 and 61 may articulate independently of each other to facilitate flexing and movement of the various frame corners 38 and 39. The upper ends of the frame halves 60 and 61 join integrally to the transverse arms 45, wherein the outer ends of the arms 45 extend outwardly and are molded integral with the vertical sides of the rear frame ring 56.

In the column base 59, this column base 59 terminates at a bottom wall 65 (FIGS. 5, 7 and 8), which is formed with a bore 66 extending vertically therethrough. The bottom wall 65 further is formed integral with the bayonet connector 49 wherein the bore 66 extends vertically through this bottom wall 65 and the bayonet connector 49 as seen in FIG. 8. When joining the back frame 23 to the chair uprights 20, the fastener 50 extends upwardly from the uprights 20 as will be described in further detail herein and then extends through the fastener bore 66 so that it projects vertically above the bottom column wall 65. The upper end of the fastener 50 is threadedly engaged by the nut 51 as seen in FIG. 8 to thereby secure the back frame 23 to the uprights 20.

Further as to the bottom column wall 65 as seen in FIG. 8, this wall 65 extends forwardly to define a horizontal leg 68 of the L-shaped flange 46, which flange 46 then turns downwardly to define a vertical leg 69. The bottom column section 59 therefore serves to rigidly support the bottom cross rail 37 of the back frame 23. As such, the bottom frame rail 37 is more rigidly supported and has less relative movement under occupant loads than the middle frame areas which are supported by the support arms 45 or the upper frame corners 38 which have the greatest amount of displaceability. In this manner, the rear frame unit 55 provides for controlled flexing of the entire back frame 23.

Figure 26:
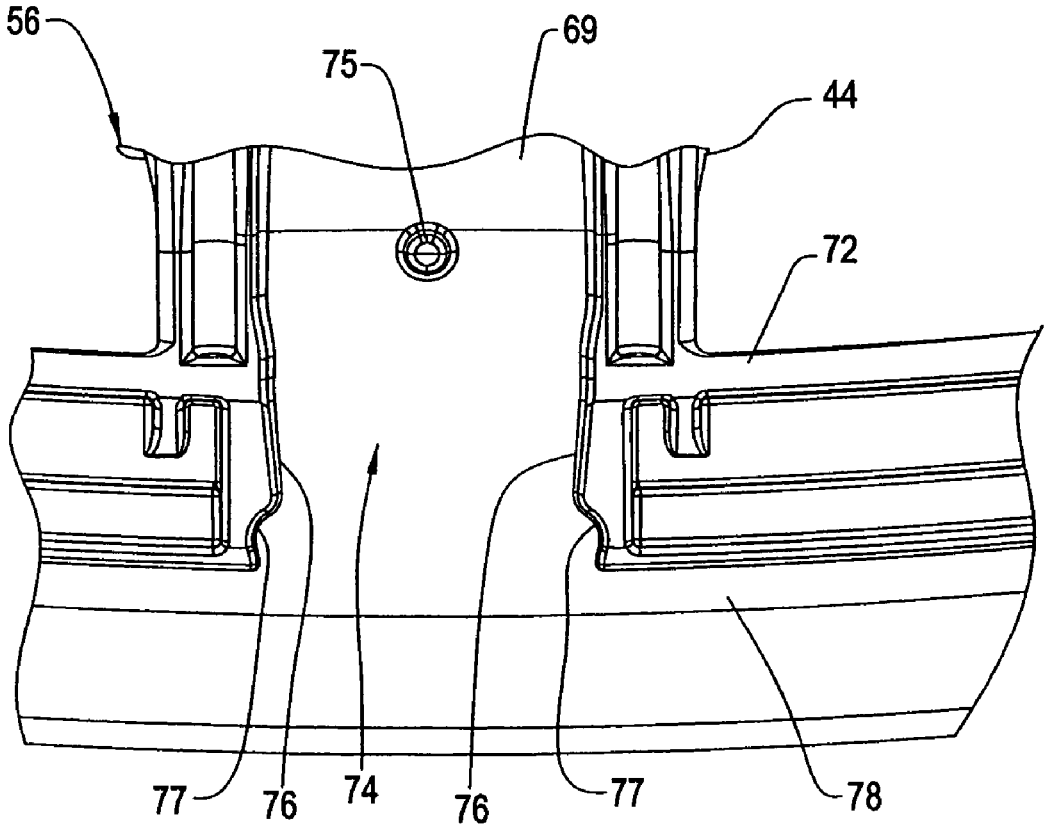
FIG. 26 is an enlarged front view of a mounting pocket in the back frame for the pelvic support unit.
Figure 27:
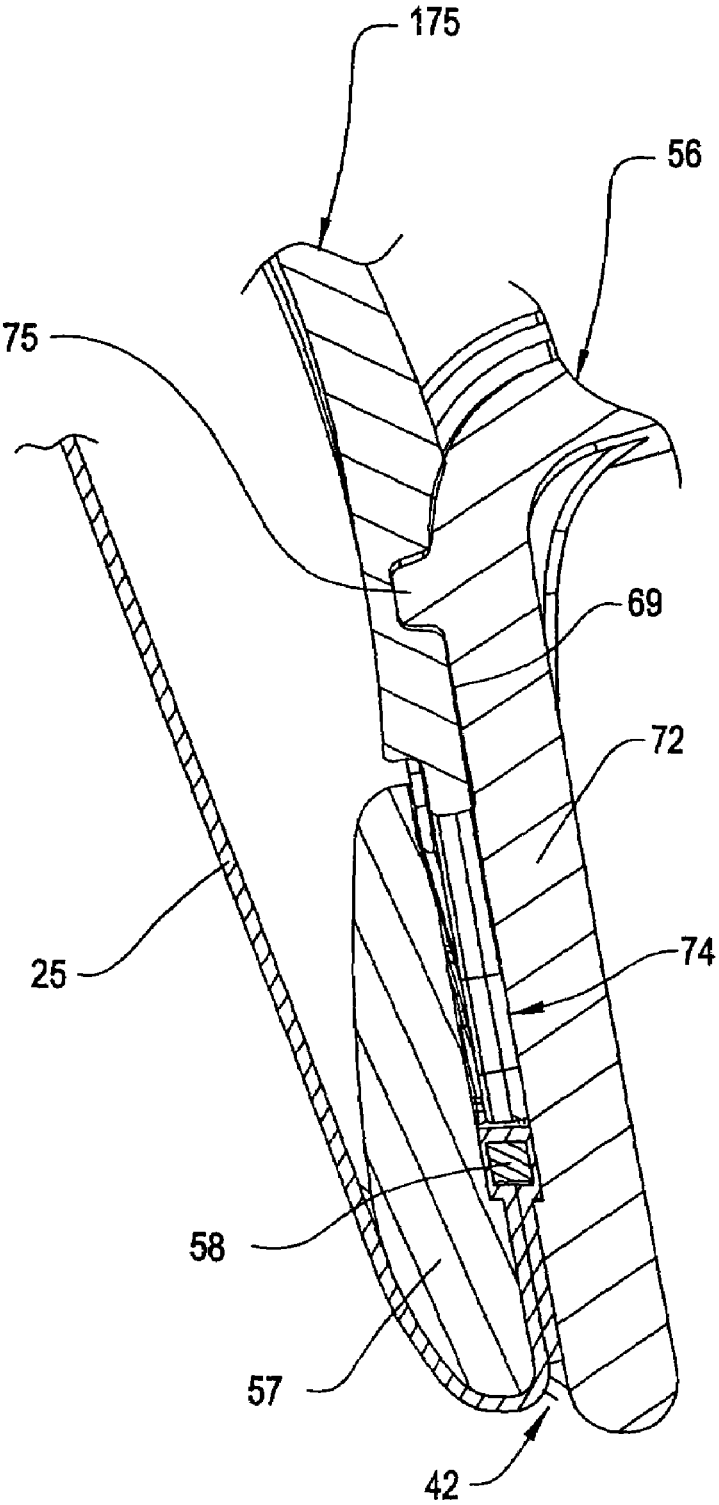
FIG. 27 is a side cross-sectional view of the connection between the pelvic support unit and the frame mounting pocket.

Referring to FIG. 7, the rear frame ring 56 comprises top and bottom ring sections 71 and 72 and left and right ring sections 73 which extend vertically. In the middle of the lower ring section 72 as seen in FIGS. 7 and 26, a recessed pocket 74 is defined which opens upwardly and is located vertically adjacent to a circular post 75 (FIG. 26), the function of which will be described in further detail hereinafter. The pocket 74 is bounded by side walls 76 which side walls 76 include notches 77 at the bottom end thereof directly adjacent to a spline groove 78, which is adapted to receive the spline 58.

As to the front frame ring 57 (FIG. 7), this frame ring has a front face 80 which faces forwardly and a rear face 81 which faces rearwardly towards the rear frame ring 56 and is adapted to abut thereagainst and be fixedly secured thereto by ultrasonic welding. This frame ring 57 is defined by vertical ring sections 82 and a top ring section 83 and a bottom ring section 84. When joined together, the front frame ring 57 and rear frame unit 55 define the back frame 23.

Turning next to the lumbar support unit 28, this unit is generally illustrated in FIGS. 5 and 6 and includes an adjustment assembly 90 which projects upwardly from the bottom of the back frame 23 and supports a lumbar support pad 91 on the upper end thereof. The adjustment assembly 90 includes a carriage 92 which is vertically movable to adjust the elevation of the lumbar pad 91 and in particular, allow the occupant to adjust the height of the pad 91 to a location along the vertical height of the occupant's back which is most comfortable.

The carriage supports a resilient support arm 93 that effectively serves as a leaf spring so that the lumbar pad 91 may float rearwardly in response to movements of the occupant while generating a resistance or counterpressure to the pressure applied by the chair occupant and the pad movement caused thereby. Further, the support arm 93 provides asymmetric support to the lumbar pad 91 such that one-half of the lumbar pad 91 may apply a lower counterpressure and displace more easily rearwardly in response to the occupant as compared to the other half of the lumbar pad 91 which may provide firmer support. Thus, the pad 91 provides adjustable counter-pressure or resistance to movement even without mechanical translation or displacement of the pad 91 by the occupant. The asymmetric support of the lumbar pad 91 is adjustable by a pair of adjustment cranks 94 and 95 (FIG. 6) which are rotatable independently of each other to independently set the support level provided to the left and right halves of the lumbar pad 91 by the support arm 93 to the occupant. Thus, as the occupant settles into the chair, this may stretch the suspension fabric 25 and displace the pad 91 in an amount which may vary depending upon the physical size of the occupant.

Figure 9:
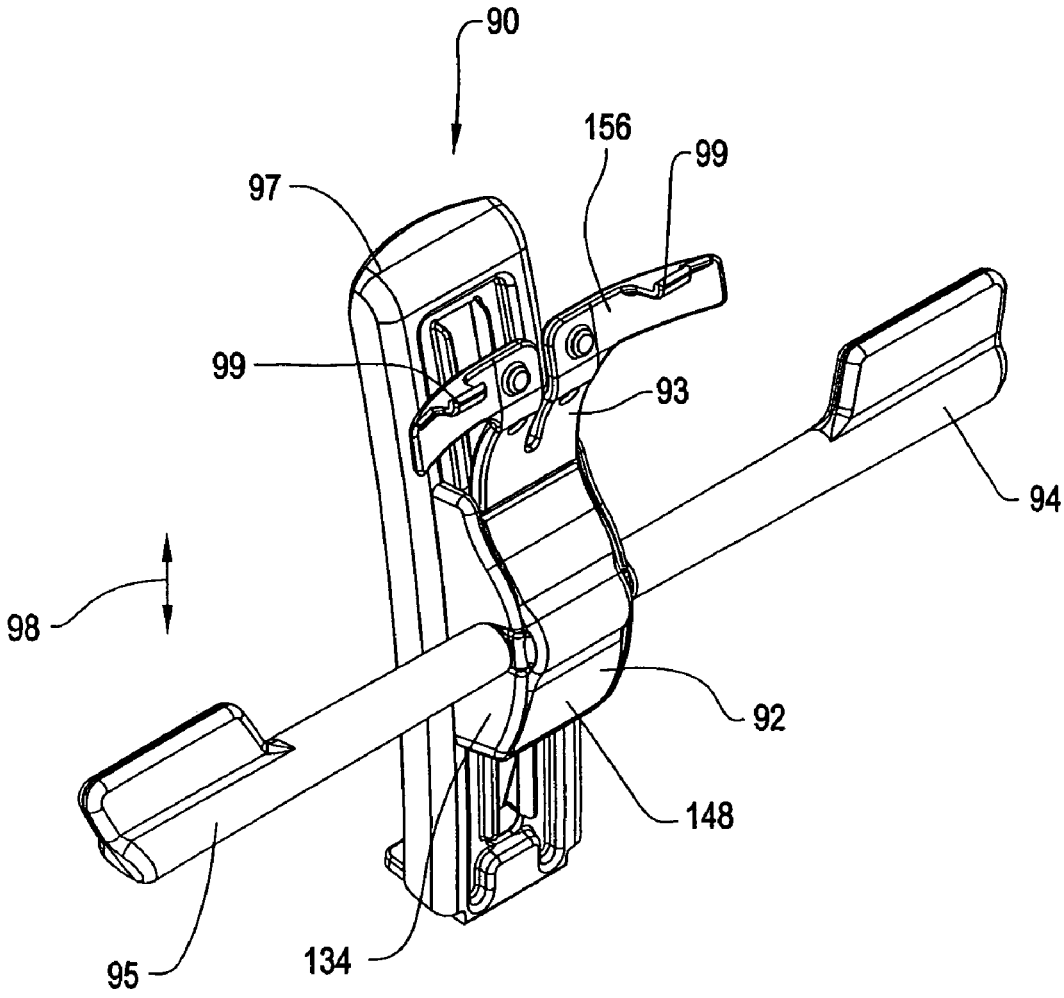
FIG. 9 is an isometric view of an adjustment assembly for the lumbar support unit.
Figure 10:
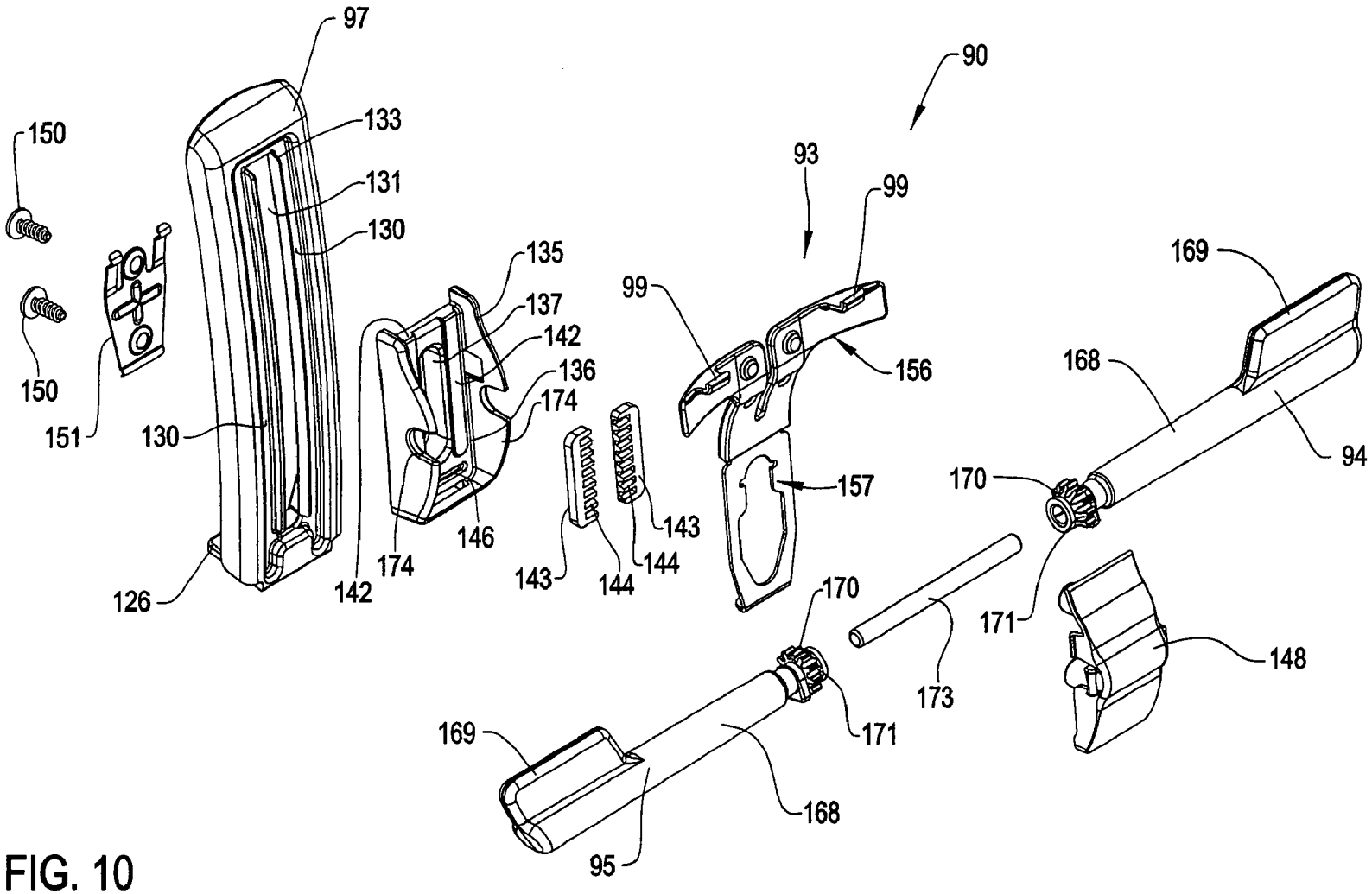
FIG. 10 is an exploded view of the adjustment assembly.
Figure 11:
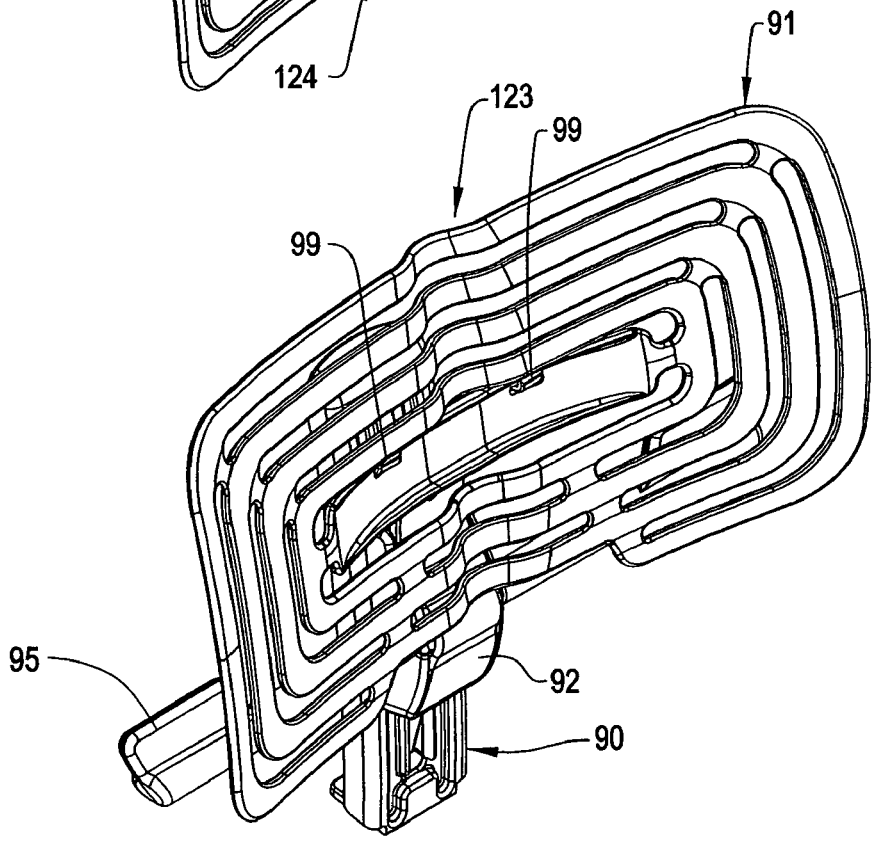
FIG. 11 is an isometric view of the lumbar support unit having a lumbar pad mounted on the adjustment assembly.

Referring to FIGS. 9 and 10, the adjustment assembly 90 generally comprises a vertical support bracket 97 which is adapted to support the carriage 92 such that it is movable vertically as generally indicated by reference arrow 98 (FIG. 9). This carriage 92 has the support arm 93 carried thereon so as to project upwardly therefrom wherein the upper edge of the support arm 93 includes a pair of hooks 99 that support the lumbar pad 91 as indicated in FIG. 11.

Referring to FIGS. 12-16, the lumbar pad 91 has an inventive construction which provides additional levels of comfort and conformability in addition to the advantages provided by the adjustment assembly 90. More particularly as to this lumbar pad 91, the pad 91 is molded of a plastic material, preferably PTEG copolyester which provides a suitable level of resilient flexibility. As will be described herein, the lumbar pad 91 has a generally rectangular shape that is defined by concentric support rings 106-109 that are radially spaced apart from each other.

Figure 17:
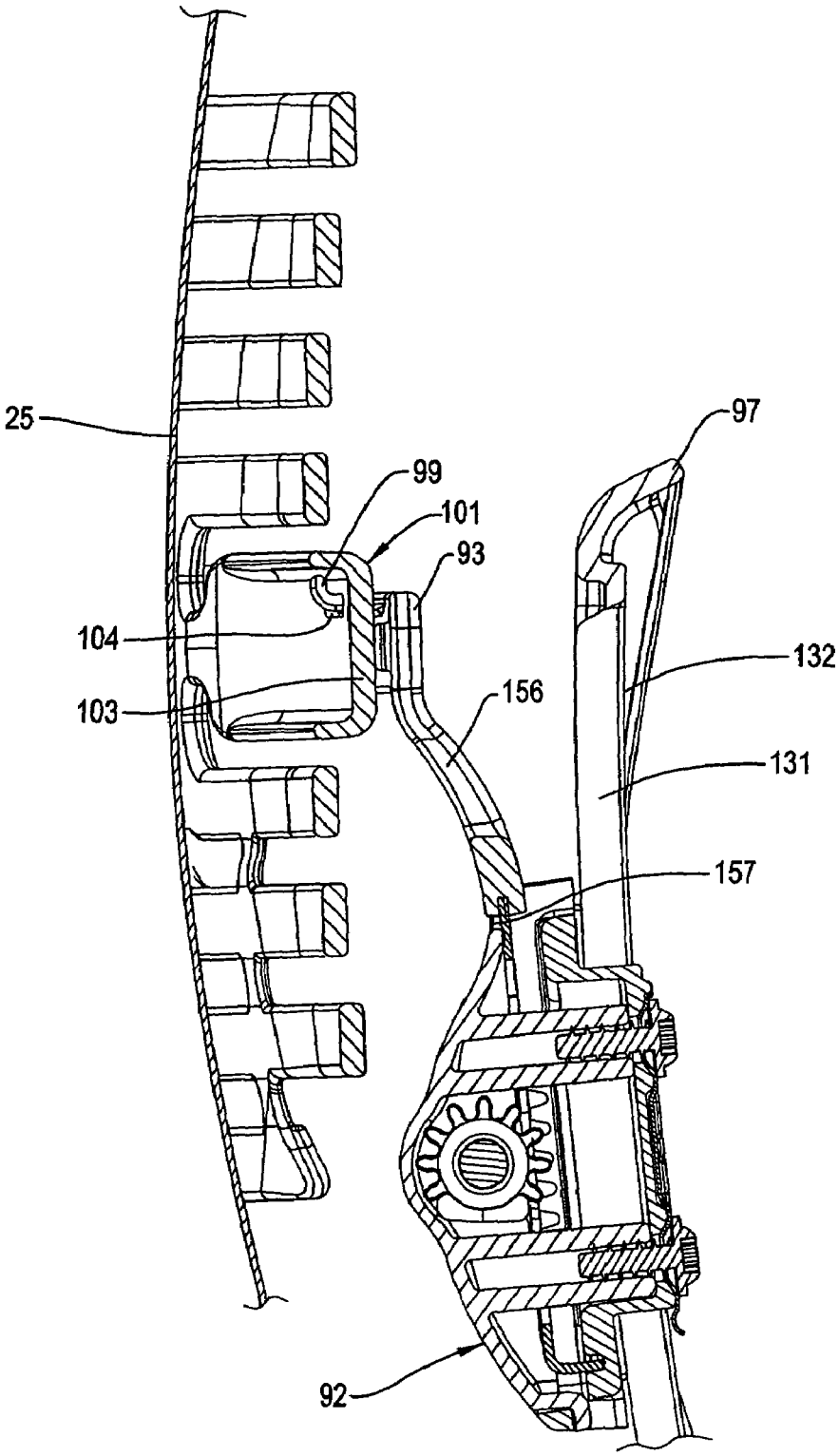
FIG. 17 is an enlarged cross-sectional view of the lumbar support unit.

More particularly, the pad 91 comprises a central mounting section 101 which is horizontally elongate and offset rearwardly relative to the front pad face 102. The mounting section 101 has a back wall 103 in which is formed a pair of suspension slots 104 as seen in FIG. 17, these slots 104 hook onto the respective arm hooks 99 wherein the lower portion of this back wall 103 then hangs against the support arm 93. No further fasteners are required for securing the lumbar pad 91 to the support arm 93. More particularly, the lumbar pad 91 may be hooked onto the hooks 99 and then pivoted downwardly to the vertical orientation of FIG. 17. While the pad 91 is not restrained and could then pivot forwardly for removal, this removal is prevented once the pad 91 is positioned in abutting relation against the opposing back face of the suspension fabric 25 which fabric 25 prevents pivoting of the pad 91 and removal from the hooks 99.

While it is known to provide a lumbar pad which has a continuous solid construction, the pad 91 of the invention is defined by a plurality of concentric support rings 106-109 which generally extend parallel to each other but are radially spaced apart from each other and are offset in the front-to-back direction. Each adjacent pair of rings is joined together by molded connector webs 111-114.

The innermost support ring 106 is joined at two locations by the webs 111 to the opposite ends of the mounting section 101 such that the vertical sections of this support ring 106 are joined to the mounting section 101 while the remaining horizontal ring sections are completely separated from the mounting section 101.

Since the rings 106-109 and webs 111-114 are all molded together as a one-piece construction, relative counter-pressure, or if displaced by the occupant, relative movement of one ring relative to the other is still permitted due to the deformability of the mold material from which the lumbar pad 91 is formed. These concentric rings 106-109 are separated from each other along most of their peripheral length so as to provide varying amounts of predesigned pressure distribution to the occupant's back and allow for greater changes to the contour of the pad face 102 when pressed rearwardly by the back of the chair occupant. In use, the forward most outer ring 109 would first contact an occupant and when pressed rearwardly by the occupant the next successive ring 108 would support the occupant. Thus, the rings 106-109 would successively become effective to support the occupant's back.

The outer three support rings 107-109 are joined one with the other by the webs 112-114. In the upper half of the pad 91, the connector webs 112-114 are located in the upper left and right corners 116. However, in the region of the lower corners 117, no such webs are provided. Rather, the additional webs 119-121 are aligned more centrally within the pad 91 and angled downwardly and outwardly. As such, the specific lumbar configuration illustrated provides more support to the occupant's back in the region of the upper corners 116 since the webs 112-114 cause these upper corner portions 116 to have somewhat greater stiffness than the top portion of the pad 91 located between these corners 116. In this middle area, the horizontal sections of the rings 106-109 are completely separated from each other and have greater relative flexibility.

In the region of the lower corners 117, however, no webs are provided such that these lower corner portions 117 are more flexible with the lower half of the pad 91 being somewhat stiffer in the region of the webs 119-121. By selective placement of the webs 111-114 and 119-121, the response characteristics of the lumbar pad 91 may be selectively designed to vary the pressure distribution in response to any deformation of the lumbar pad 91 caused by contact with the occupant. Further, the performance characteristics can be varied depending upon the height, width, placement and number of webs 111-114 and 119-121.

With respect to FIG. 16, it is noted that the cross-sectional shape of each of the rings 106-109 is consistent and is generally rectangular. However, the thickness, cross-sectional shape and width of these rings 106-109 also could be varied to vary the response characteristics of this lumbar pad 91.

Figure 12:
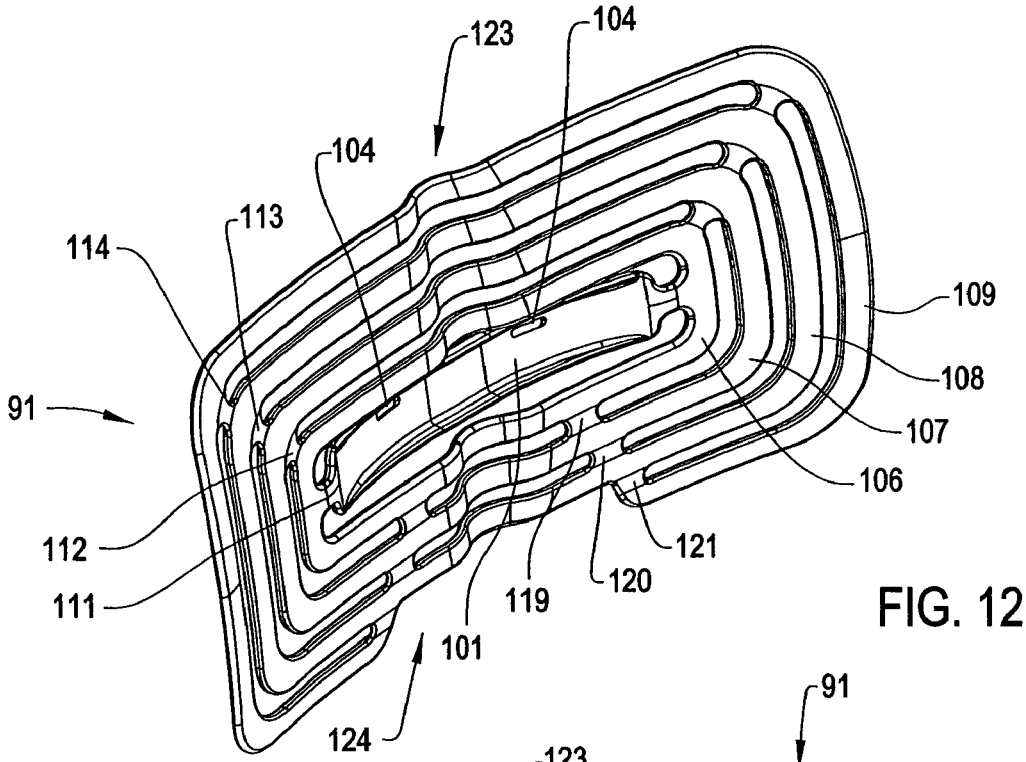
FIG. 12 is an isometric view of the lumbar pad.

In addition to the foregoing, it is noted that each of the rings 106-109 has a rearwardly curved portion in the region of the vertical center line of the lumbar pad 91 so as to form a central groove 123 (FIGS. 12 and 14). This central groove 123 aligns with the spine of a chair occupant and is provided to minimize and preferably eliminate any physical contact between the lumbar pad 91 and the spinal column of the occupant since pressure on the spinal column is uncomfortable and undesirable.

It will be understood that while the various connector webs 111-114 and 119-121 are generally diagonally aligned, it is possible to provide additional webs in the regions between these locations and that the webs also could be provided in alternate positions, such as staggered from each other, to provide alternative response characteristics to the lumbar pad 91.

Also, the inner support rings 106-108 are formed as endless loops. The outermost ring 109 is substantially similar except that a central portion on the bottom of the lumber pad 91 is omitted. Specifically, the region of the outer ring 109 between the webs 121 is not provided so that the lumber pad 91 has a space or notch 124 (FIGS. 12 and 13) formed therein to provide a clearance space for the pelvic support unit 29 which is disposed adjacent thereto and may be located in this space when the lumbar pad is at its lowest position. In this position, the pelvic pusher 29 and lumbar pad 91 have some overlap.

Figure 20:
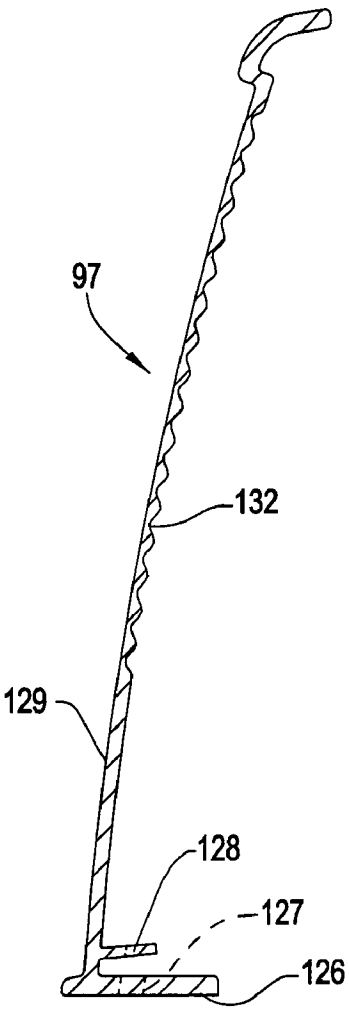
FIG. 20 is a side cross-sectional view of the support bracket as taken along line 20-20 of FIG. 19.
Figure 19:
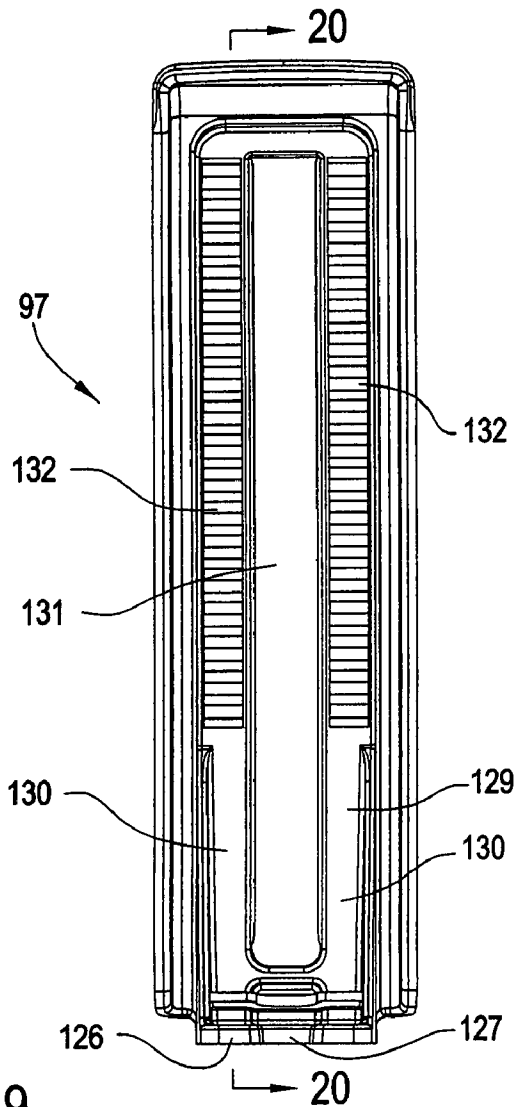
FIG. 19 is a rear view of a support bracket for the adjustment assembly.

Turning next to the adjustment assembly 90, this assembly 90 includes the upright support bracket 97. This support bracket 97 as seen in FIGS. 19 and 20 is formed with a base wall 126 that extends horizontally and has a fastener slot 127 in the center portion thereof so that the bottom bracket wall 126 is able to receive the bolt 50 vertically therethrough as illustrated in FIG. 8. An additional locator flange 128 is provided above the base wall 126 so as to receive an edge of the nut 51 therebetween as again seen in FIG. 8. As a result, the support bracket 97 is rigidly fastened to the column base end 59 as seen in FIG. 5 and projects vertically therefrom so as to position the lumber pad 91 adjacent the suspension fabric 25.

Further as to the support bracket 97, this bracket 97 includes a front wall 129 that is generally arcuate and has a pair of side wall sections 130 separated by a vertically elongate guide slot 131. This guide slot 131 cooperates with the aforementioned carriage 92 to guide vertical sliding thereof.

The wall sections 131 include a vertical row of teeth 132 which also cooperate with the carriage 92 to selectively hold the carriage 92 at a selected elevation while also permitting the carriage 92 to be moved vertically merely by having the occupant push on the carriage 92.

Referring to FIG. 10, the front side of the wall sections 130 opposite to the ratchet teeth 132 are formed as vertically elongate slots 133.

Figure 18:
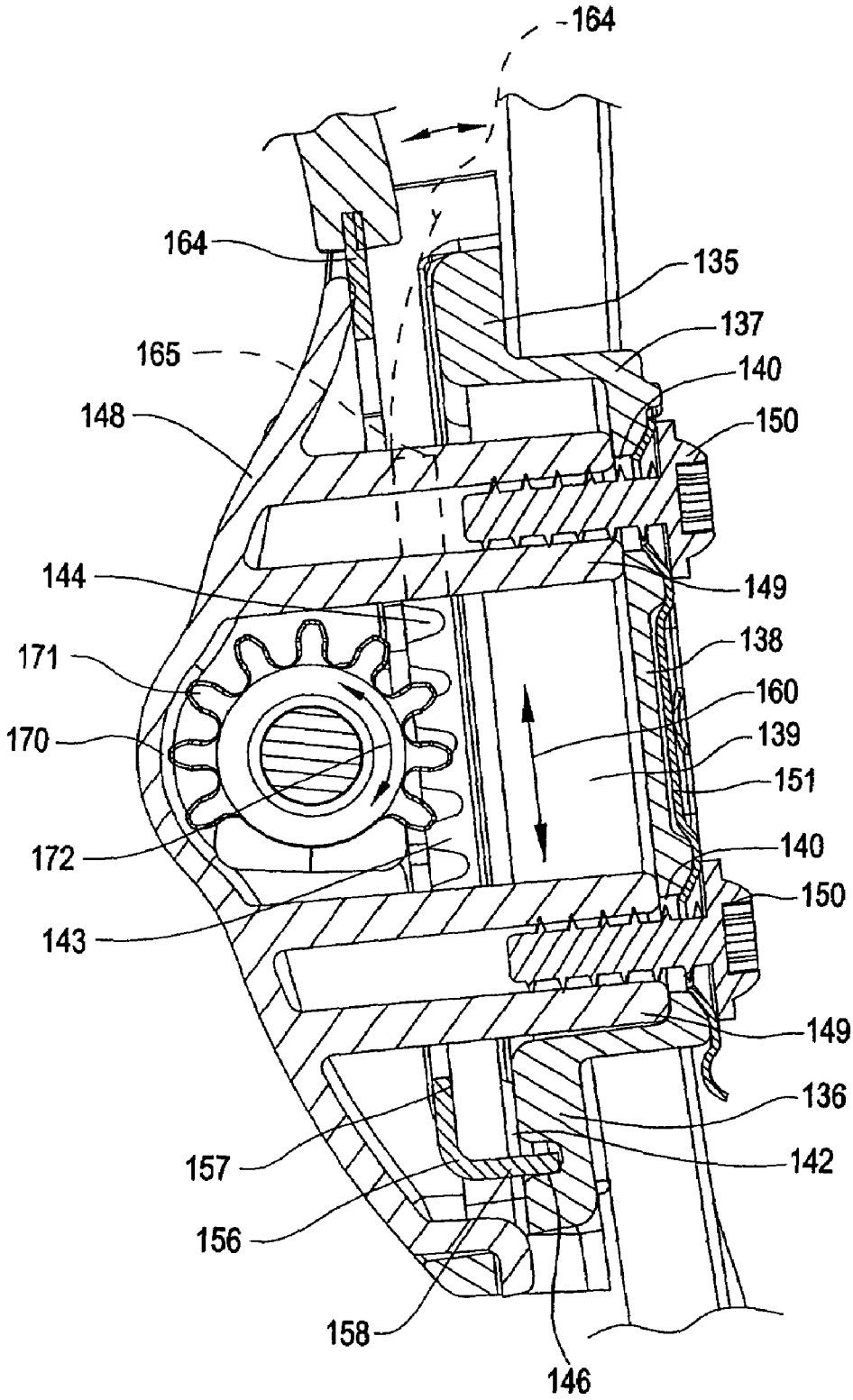
FIG. 18 is an enlarged cross-sectional view of the adjustment assembly.

To permit sliding of the carriage 92, this carriage 92 includes a slide housing 135 which slidably engages the guide slot 131. The slide housing 135 includes a main wall 136, and a projecting guide portion 137 which is vertically elongate and is slidably received within the guide slot 131. This guide portion 137 includes a back wall 138 which projects partially out of the slot 127 as seen in FIG. 18, wherein the guide portion 137 is generally cylindrical and defines an interior chamber 139. Further, the back wall 138 has a pair of vertically spaced apart fastener bores 140.

Referring to FIGS. 10 and 18, the front of the slide housing 135 is formed with a pair of channels 142 which extend vertically and each receive a respective fulcrum block 143 therein. Each fulcrum block 143 is formed generally as a rectangular plate and includes a vertical row of rack teeth 144. As described further herein, the fulcrum blocks 143 are driven by the adjustment cranks 94 and 95 to adjust the vertical position of the fulcrum blocks 143 independently of each other.

The slide housing 135 also includes a connector slot 146 (FIGS. 10 and 18) for the support arm 93. To secure the slide housing 135 onto the support bracket 97, a housing cover 148 is provided which defines an exposed exterior face of the carriage 92. The housing cover 148 includes a pair of rearwardly projecting fastener posts 149 which are adapted to receive fasteners 150 in threaded engagement therewith. These fasteners 150 pass through a retainer plate 151 that is located on the back side of the support bracket 97 and prevents removal of the slide housing 135 from the support bracket 97.

Figure 22:
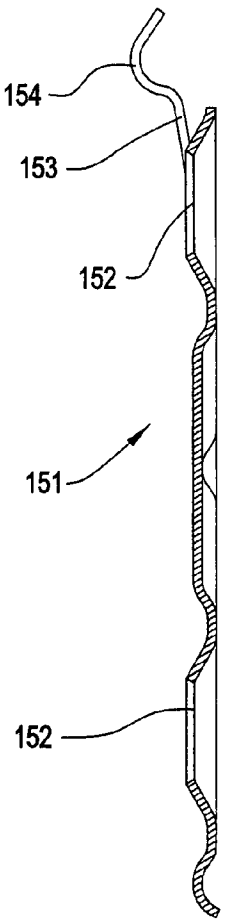
FIG. 22 is a side cross-sectional view of the retainer plate as taken along line 22-22 of FIG. 21.
Figure 21:
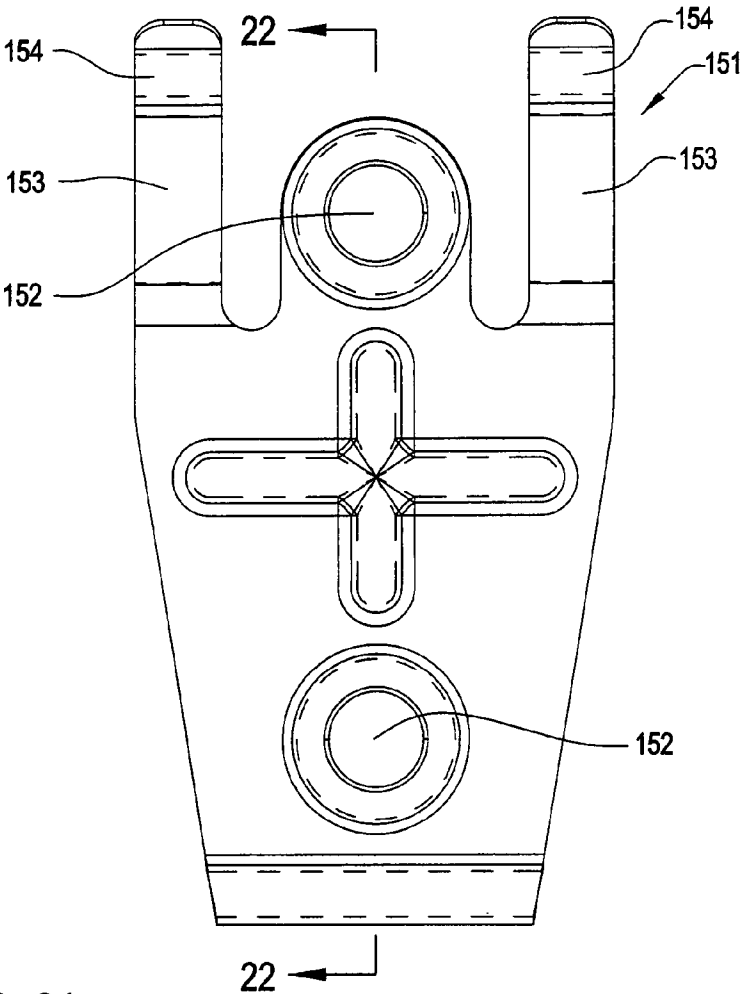
FIG. 21 is a front view of a resilient retainer plate.

Referring to FIGS. 21 and 22, this retainer plate 151 includes a pair of fastener holes 152 through which the fasteners 150 are received. The retainer plate 151 is formed of a resilient spring steel and is adapted to engage the teeth 132 in releasable engagement therewith. In particular, the plate 151 includes a pair of cantilevered fingers 153 which have an arcuate detent 154 at the upper end thereof to engage the respective rows of teeth 132 which straddle the bracket guide slot 131. Therefore, the retainer plate 151 prevents removal of the slide housing 135 while also engaging the teeth 132 to permit sliding of the carriage 92 under sufficient force while also preventing unwanted displacement in the absence of a manual adjustment force. In this manner, the carriage 92 is maintained on the support bracket 97 and is vertically adjustable. Since the lumbar pad 91 is supported on this carriage through the upstanding support arm 93, the height of the lumber pad 91 is adjusted by moving the associated carriage 92.

Referring to this resilient support arm 93, this support arm 93 is formed of a resilient spring steel so that it is resiliently deflectable. The support arm 93 is formed of a cantilevered spring body 157 (FIG. 23-25) on which is supported a connector yoke 156. This connector yoke 156 includes the above-described hooks 99 thereon and is frictionally fitted onto the upper end of the spring body 157.

Figure 25:
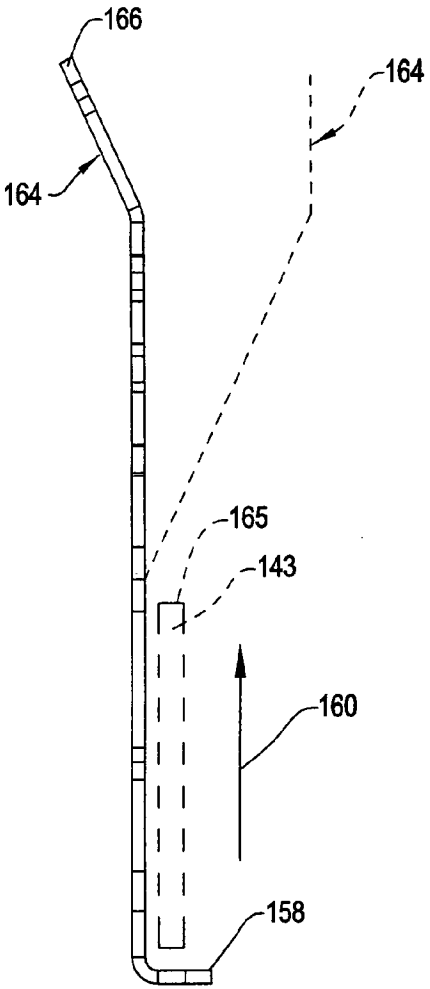
FIG. 25 is a right side view of the spring plate with its right side deflection illustrated in phantom outline.
Figure 23:
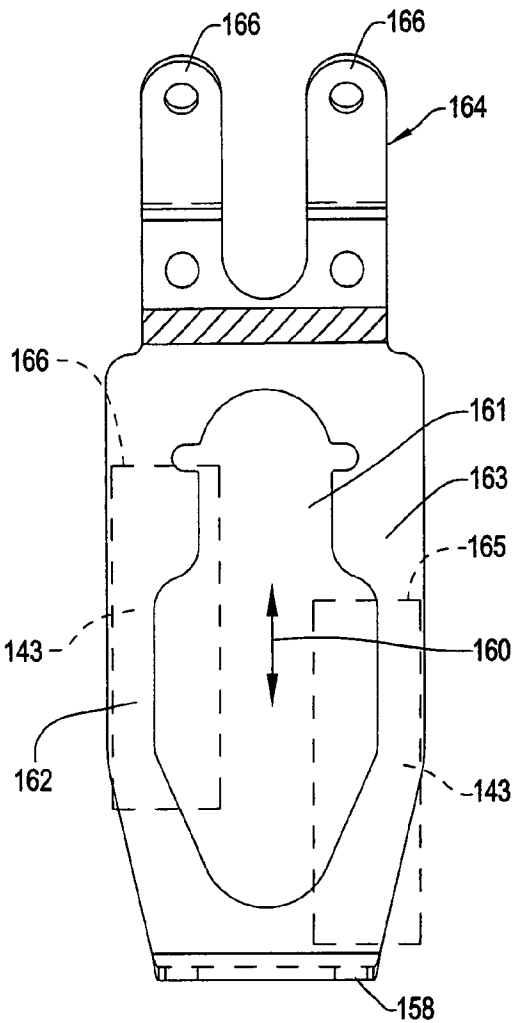
FIG. 23 is a front view of a resilient spring plate for the lumbar support unit.
Figure 24:
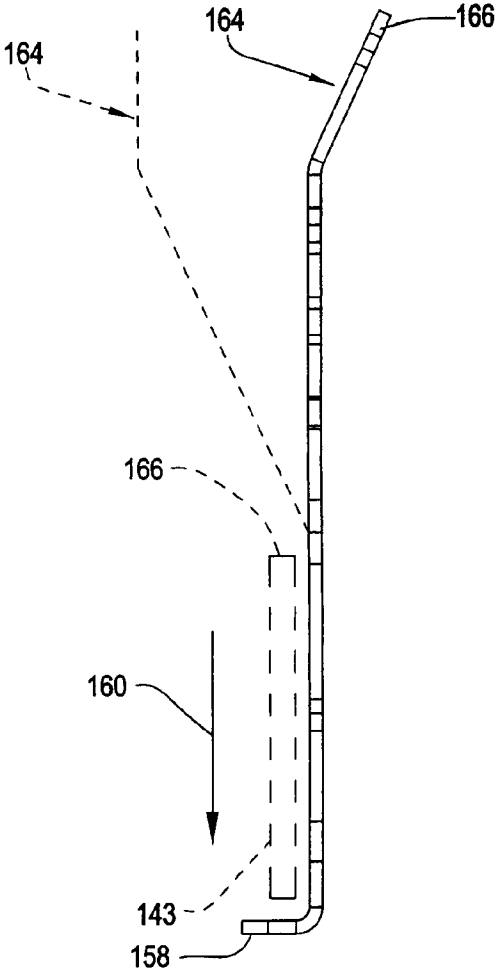
FIG. 24 is a left side view of the spring plate with its left side deflection illustrated in phantom outline.

More particularly referring to FIGS. 23-25, the spring body 157 has a rearwardly projecting locator flange 158 on the bottom edge thereof. As seen in FIG. 18, this locator flange 158 seats within the associated connector slot 146 on the slide housing 135. When located therein, the main spring body 157 extends upwardly between the slide housing 135 and the housing cover 148 with the fulcrum blocks 143 being sandwiched between this main spring body 157 and the opposing main wall 136 of the slide housing 135. While the spring body 157 remains vertically stationary, these fulcrum blocks 143 are free to slide vertically as indicated by reference arrow 160 in FIGS. 18 and 23-25.

As to FIG. 23, the spring body 157 has a central opening 161 which separates the spring body 157 into plate halves 162 and 163. Each respective fulcrum block 143 cooperates or slides directly adjacent to and in contacting relation with a respective one of the plate halves 162 or 163 with the rack teeth 144 being exposed within the opening 161. As such, each of the plate halves 162 and 163 has one fulcrum block 143 sliding along one face thereof.

As seen in FIG. 18, when the components are assembled together, the upper end 164 of the spring body 157 is able to deflect rearwardly as indicated in phantom outline at the location defined directly above the uppermost edge 165 or 166 of the fulcrum blocks 143. In effect, these upper edges 165 and 166 define fulcrum points or bend points at which the upper portions of the respective spring halves 161 and 162 are able to deflect rearwardly.

As seen in FIG. 23, these fulcrum blocks 143 are independently movable and may be vertically offset relative to each other such that the left and right spring halves 161 and 162 have different bending characteristics. In particular, the right spring half 163 would be able to bend easier than the left spring half 162. As such, with the blocks 143 vertically offset, the right spring half 163 as seen in FIG. 25 is free to bend at a lower bend point while the left spring half 162 would bend at a higher location. The upper end of the spring plate 157 includes separated fingers 166 on which the yoke 156 is supported. These fingers 166 further facilitate asymmetric movement of the lumbar pad 91.

Since this spring plate 156 provides resilient support to the lumbar pad 91, this spring plate 156 thereby provides asymmetric support to this lumbar pad and allows the left and right halves of the lumbar pad 91 to have different performance characteristics. In particular, the left spring half 162, as illustrated, would provide greater resistance to displacement of the left half of the lumbar pad 91 while the right spring half 163 would provide less resistance to this rearward displacement of the right pad half. This resistance also could be equalized by aligning the fulcrum blocks 143 with each other.

To selectively adjust the vertical position of these fulcrum blocks 143, the adjustment cranks 94 and 95 are provided. These cranks 94 and 95 have a main shaft 168 on which a hand piece 169 is supported on the outer end thereof. The inner end of the main shaft 168 includes a drive gear 170 with gear teeth 171 that extend partially around the circumference as best seen in FIG. 18 wherein the gear 170 is rotatable in the direction of reference arrow 172. The inner end of the shaft 168 is rotatably supported on an intermediate support axle 173 wherein the inner ends of both shafts 168 are supported by the side walls 174 of the slide housing 135.

The drive gears 170 engage the rack teeth 144 on the fulcrum blocks 143 so that rotation of these drive gears 170 causes vertical displacement of the blocks 143. While the main shafts 168 are supported on the common support axle 173, the shafts 168 are rotatable independently of each other so that each adjustment crank 94 or 95 may be independently rotated to adjust the position of one fulcrum block 143 completely independently of the other block 143 in accord with FIGS. 23-25. In this manner, the chair occupant can readily adjust the asymmetric support provided to the lumbar pad 91 to a level that is most comfortable without causing movement of the pad 91. This support is provided by the pad 91 to counteract the pressure applied by the occupant even without flexing of the arm 93 from a stopped position.

In addition to the foregoing lumbar support unit 28, an additional pelvic support unit 29 is also provided as illustrated in FIGS. 26-30. More particularly as to the rigid frame pocket 74 formed in the back frame ring 56, this pocket 74 is provided to support the lower end of a pelvic support 175 which faces forwardly and is adapted to press against the rear pelvic region of a chair occupant.

Figure 28:
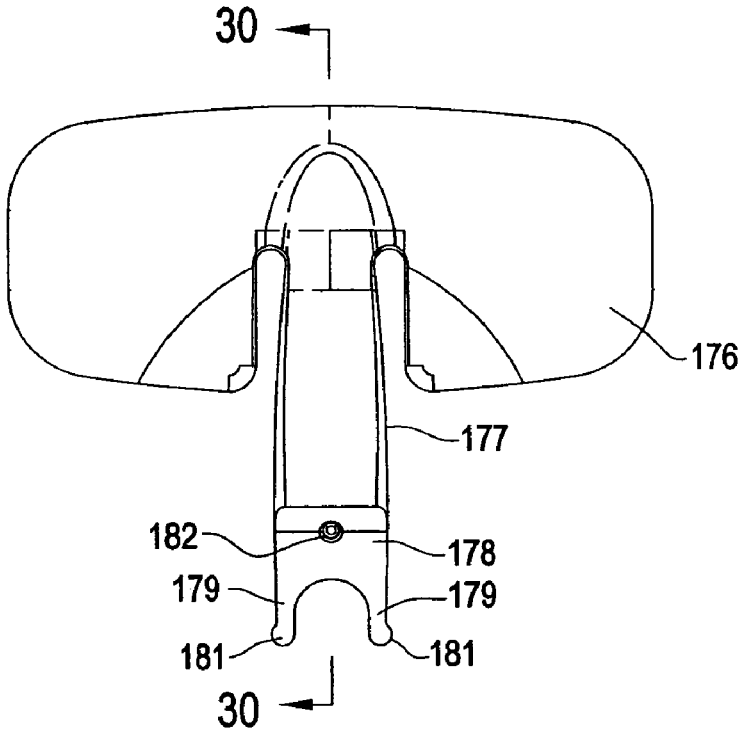
FIG. 28 is a front view of the pelvic support unit.
Figure 29:
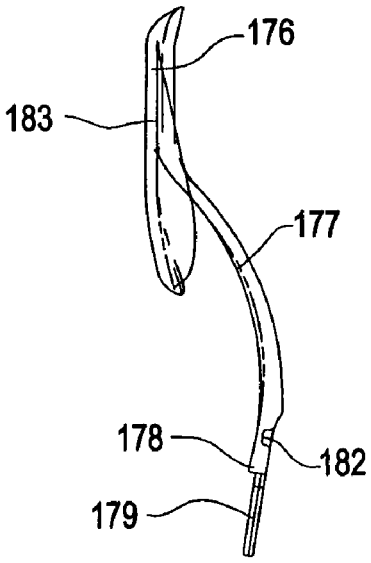
FIG. 29 is a side view of the pelvic support unit.
Figure 30:
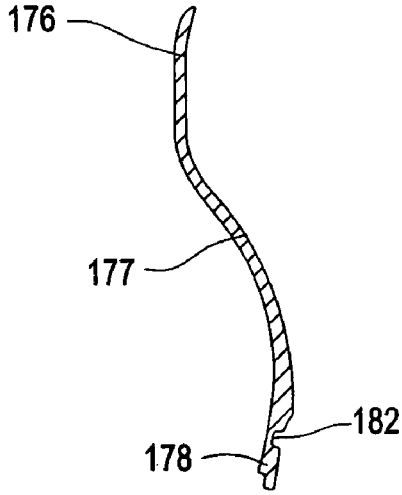
FIG. 30 is a side cross-sectional view of the pelvic support unit as taken along line 30-30 of FIG. 28.
Figure 32:
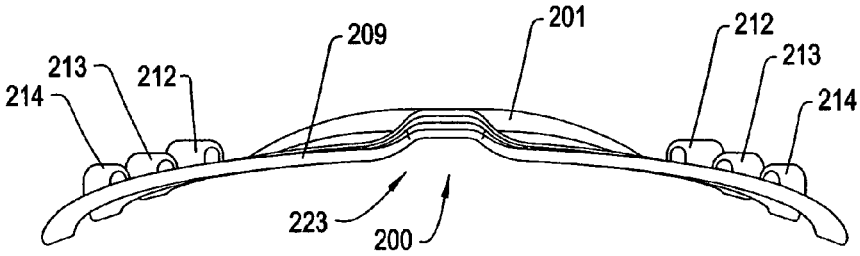
FIG. 32 is a top view thereof.
Figure 31:
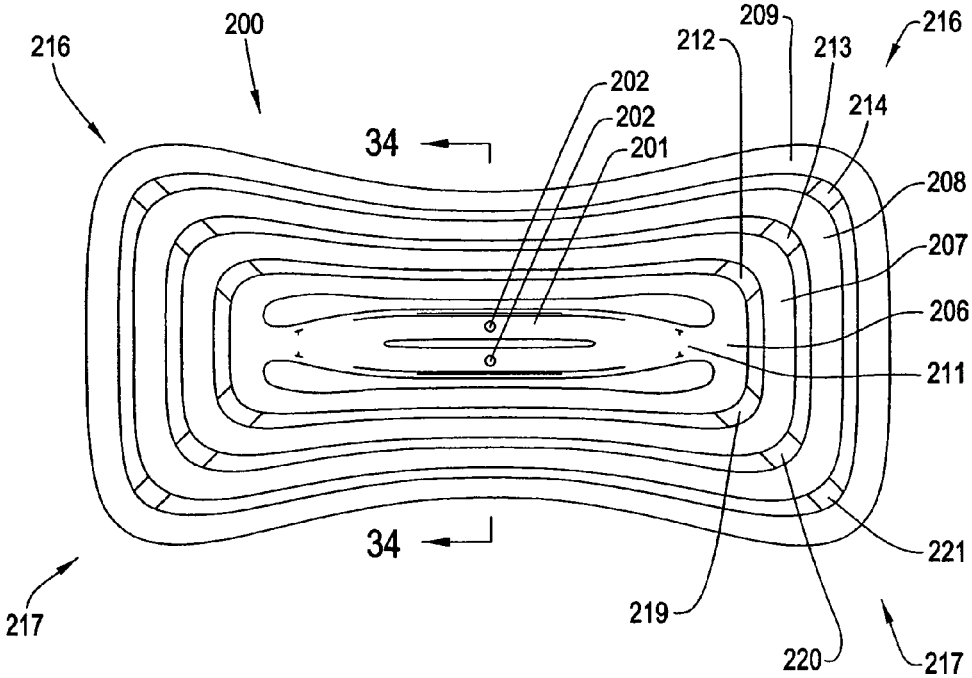
FIG. 31 is a front view of a second embodiment of a lumbar support pad.
Figure 34:
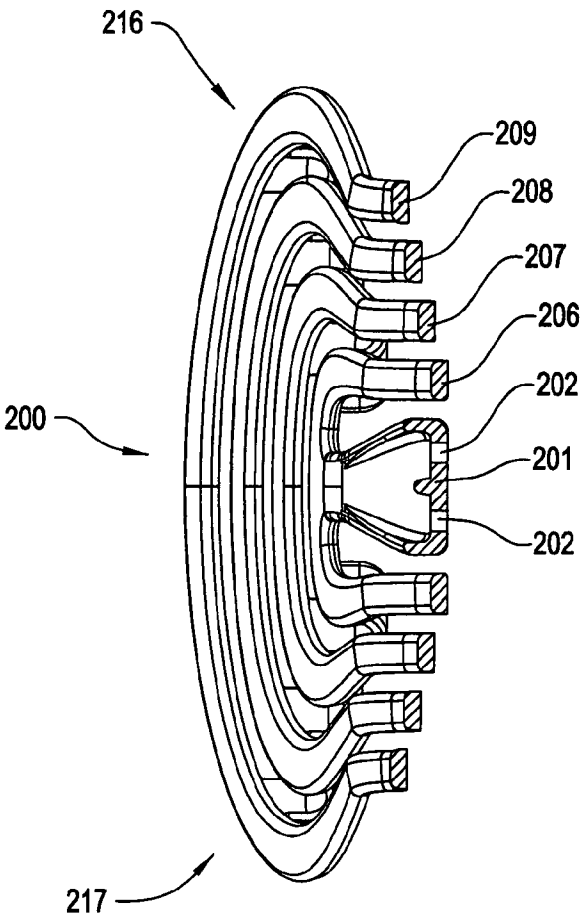
FIG. 34 is a side cross-sectional view of the lumbar support pad as taken along line 34-34 of FIG. 31.
Figure 33:
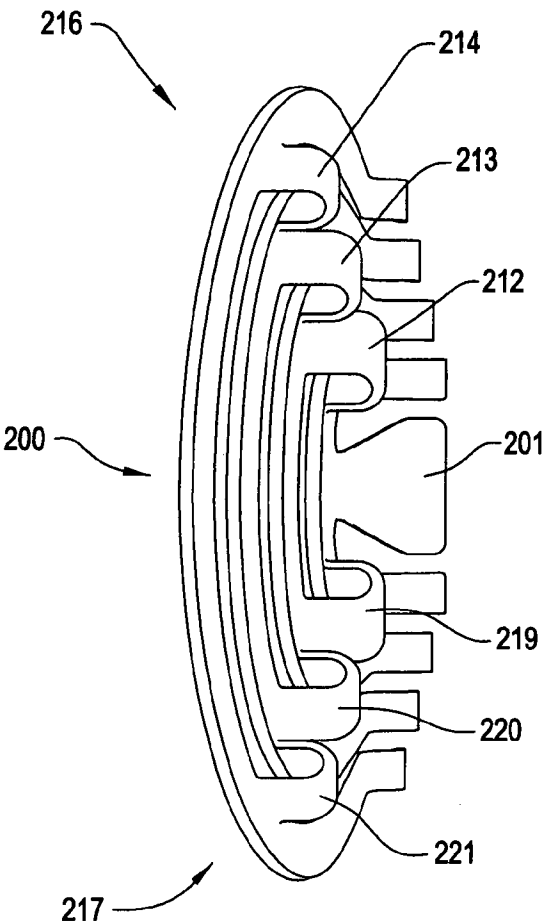
FIG. 33 is a side view thereof.

Referring to FIGS. 28-30, the pelvic support or pusher 175 has an enlarged panel 176 that is supported on a cantilevered support arm 177. The lower end of the support arm 177 has a plug portion 178 which is forked to define a pair of legs 179. The distal ends of the legs 179 include nubs 181 that project sidewardly or outwardly for engagement with the notches 77 formed in the pocket 74.

Also the plug portion 178 includes a locking recess 182 which opens rearwardly and essentially is defined by a blind bore. When the front and rear frame rings 56 and 57 are fixed together (FIG. 27) as by welding, the support pocket 74 still opens upwardly from between the interface between these two ring sections 56 and 57. This permits the plug portion 178 of the pelvic support 175 to be plugged downwardly into the pocket 74. During this downward insertion, the connector legs 179 deflect inwardly toward each other until the nubs 181 align with the corresponding pocket notches 77 and then return to their undeflected condition with the nubs 181 seated in the notches 77.

Since the pelvic support 175 is formed of a resiliently deflectable material such as plastic, the support arm 177 is able to bend forwardly during insertion or even for removal to permit the pocket post 75 to slide upwardly until it aligns with the corresponding locking recess 182, after which the support arm 177 returns to its undeflected condition with the post 75 seated within the recess 182. These cooperating components prevent vertical displacement of the pelvic support 175.

Since the resiliently deflectable suspension fabric 25 lies against the front face 183 (FIG. 5) of the support panel 176, the fabric 25 tends to press the pelvic support 175 rearwardly so that the stop post 75 is most effective in preventing removal of the pelvic support 175. However, since the suspension fabric 25 also is stretchable, the pelvic support 175 may still be bent forwardly to permit removal of same from the support pocket 74.

The above-described discussion relates to the preferred lumbar support unit 28 and pelvic support unit 29. The lumbar pad 91 may also have an alternative configuration as illustrated in FIGS. 31-34.

More particularly, this alternative lumbar pad 200 is substantially similar to the lumbar pad 91 except for differences in the overall shape, web locations and the web construction.

More particularly, this lumbar pad 200 includes a central mounting section 201 which in this instance includes fastener holes 202 to allow for fixed attachment of this lumber pad 200 to an appropriate support arm that would have screw holes rather than the hooks 99. This particular lumbar pad 200 has an hourglass shape defined by larger outer ends and a narrower center area.

The pad 200 is defined by a plurality of concentric support rings 206-209 which are joined in radially separated relation by connector webs 211-214 and additional connector webs 219-221 and successively become effective or come into supporting contact with the occupant's back. As such, the outer ring 209 is effective first with the inner rings successively become effective as the occupant causes the rings to displace rearwardly. In this configuration, the innermost ring 206 is connected to the central section 201 by the pair of connector webs 211 that are formed substantially similar to the webs 111 described above. Additionally, the outer support rings 207-209 are supported by the connector webs 212-214, which webs 212-214 extend diagonally outwardly at the upper pad corners 216.

The pad 200 differs in that the connector webs 219-221 are located diagonally adjacent to each other at the lower corners 217 of the pad 200 which therefore provides response characteristics at the upper corners 216 and lower corners 217 that are substantially similar. This also provides greater flexibility in the spinal area of the bottom half of the pad 200 since the connector webs 219-221 are shifted farther outwardly as compared to the connector webs 119-121.

Further, the webs 212-214 and 219-221 differ in that they are formed as rearwardly curving shapes. Due to the resiliency of the mold material, these webs 212-214 function more as J-shaped springs as opposed to the flatter webs 112-114 and 119-121. This allows radially adjacent rings to move more independently of each other since there is more length to the webs 212-214 and 219-221 as compared to the flatter webs described above which therefore provides more resiliency.

Like the pad 91, this pad 200 also includes a central clearance groove 223 in the area of the spinal column to avoid contact with this part of the occupant's body.

With the above-described invention, an improved lumbar pad construction is provided. Additionally, an improved arrangement for supporting the lumbar pad is provided which provides for asymmetric performance by this lumbar pad and asymmetric support loads being provided thereto.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a chair comprising a seat-back assembly for supporting a chair occupant, said chair including a lumbar support arrangement mounted on a back of the chair which comprises a lumbar pad positioned on the back so as to support a lumbar region of the occupant when disposed thereon, said lumbar pad comprising left and right halves disposed in opposite sides of a vertical centerline of the lumbar pad, said lumbar pad asymmetrically supporting the occupant's lumbar region wherein the left and right halves generate a pressure distribution over respective support surfaces thereof, and the pressure distribution provided by one of said pad halves is set to asymmetrically differ on one said side of said centerline from the pressure distribution provided by the other of the pad halves on the other said side of said centerline.

2. The chair according to claim 1, wherein said pressure distributions are selectively variable on the left and right halves to permit adjustment of the pressure distributions between symmetric levels and asymmetric levels.

3. The chair according to claim 1, wherein said chair further includes a support unit disposed on said back which has a fixed end connected to a frame of the back and a support end which is connected to said lumbar pad, said support unit including first and second support sections which respectively support said left and right pad halves and define said variable pressure distributions.

4. The chair according to claim 3, wherein said first and second support sections include respective independent adjustment mechanisms which are manually adjustable independent of each other to vary the respective pressure distributions between symmetric levels and asymmetric levels.

5. The chair according to claim 3, wherein said support sections are defined by leaf spring sections which are separated at least along a portion of a length thereof.

6. A lumbar pad for a chair comprising a plurality of concentric elastomeric rings which are disposed one inside of the other and have adjacent peripheral edges which are spaced from each other such that said support rings are separated from each other along a majority of the peripheral length thereof, said pad further including connector webs extending radially crosswise between adjacent rings to join each said support ring to an adjacent said support ring, each of said adjacent pairs of said support rings having a plurality of said connector webs which are peripherally spaced apart from each other.

7. The lumbar pad according to claim 6, wherein said lumbar pad has opposite side sections disposed on opposite sides of a vertical centerline extending across a face of the lumbar pad, said connector webs and said lumbar pad being disposed at variable distances from said centerline to govern the pressure distribution applied by said lumbar pad to the back of a chair occupant disposed in contact therewith.

8. The lumbar pad according to claim 7, wherein said lumbar pad includes upper and lower corners wherein said connector webs are disposed farther from said centerline to provide greater rigidity as opposed to additional said connector webs disposed closer from said centerline which provide additional flexibility to said corners.

9. The lumbar pad according to claim 8, wherein said connector webs in an upper half of said lumbar pad are disclosed closer to said upper corners to provide greater rigidity and said connector webs disposed closer to a bottom half of said lumbar pad are disclosed farther from said corners to provide greater flexibility to said lower corners.

10. The lumbar pad according to claim 6, wherein said lumbar pad has a substantially rectangular shape.

11. The lumbar pad according to claim 6, wherein said lumbar pad has an hourglass shape which has a greater vertical dimension proximate to outer side edges of said lumbar pad as opposed to a vertical dimension of said lumbar pad in a region of said centerline.

12. A lumbar support mechanism for a chair comprising:

a lumbar support pad having a front support surface adapted to contact and support a lumbar region of a chair occupant's back, said lumbar pad having opposite side sections disposed on opposite sides of a vertical centerline extending across said support surface, said lumbar pad assembly being arranged to provide asymmetric support to said lumbar pad on opposite sides of said centerline to generate pressure distributions over said pad sections which are asymmetrically variable relative to said centerline to vary the pressure distributions provided by said support surface through said pad sections on said opposite sides of said centerline; and a support mechanism having a connector bracket for mounting said lumbar pad assembly to a chair and said support mechanism further including a support arm arrangement which provides variable support to said pad sections, said support mechanism further including an adjustment mechanism for varying the support provided by left and right sections of said support mechanism to said lumbar pad to independently vary the pressure distribution on one said side of said centerline relative to the pressure distribution on the other side of said centerline.

13. The lumbar pad assembly according to claim 12, wherein the left and right sections of said support mechanism are defined by a cantilevered leaf spring having left and right edge portions thereof being at least partially separated along a length thereof wherein said edge portions are connected respectively to said pad sections.

14. A lumbar support mechanism for a chair comprising:

a lumbar support pad having a front support surface adapted to contact and support a lumbar region of a chair occupant's back, said lumbar pad having opposite side sections disposed on opposite sides of a vertical centerline extending across said support surface, said lumbar pad assembly being arranged to provide asymmetric support to said lumbar pad to generate pressure distributions over said pad sections which are asymmetrically variable to vary the pressure distributions provided by said support surface through said pad sections; and a support mechanism having a connector bracket for mounting said lumbar pad assembly to a chair and said support mechanism further including a support arm arrangement which provides variable support to said pad sections, said support mechanism further including an adjustment mechanism for varying the support provided by left and right sections of said support mechanism to said lumbar pad, the left and right sections of said support mechanism being defined by a cantilevered leaf spring having left and right edge portions thereof being at least partially separated along a length thereof wherein said edge portions are connected respectively to said pad sections, said adjustment assembly includes first and second adjustment mechanisms cooperating respectively with said edge sections, said adjustment mechanisms being independently adjustable to vary the spring characteristics of the edge sections.

15. The lumbar pad assembly according to claim 14, wherein said adjustment mechanisms adjust a fulcrum point at which said edge sections are supported to vary the support load provided by said edge sections.

16. The lumbar pad assembly according to claim 12, wherein said support mechanism further includes a carriage which is vertically movable relative to said connector bracket to vary a vertical height of said lumbar pad relative to the lumbar region of the occupant.

17. The lumbar pad assembly according to claim 12, wherein said adjustment mechanism includes separate adjustment mechanisms for adjusting the left and right support sections and vary the support provided thereby to said respective pad sections and thereby vary the pressure distributions applied by said lumbar pad support surface to the lumbar region of the occupant.

18. A lumbar pad assembly comprising:

a lumbar pad, said lumbar pad comprising pad sections defining left and right halves disposed on opposite sides of a vertical centerline of said lumbar pad; and a support mechanism comprising a base adapted to be mounted to a chair, and a support arm connected to said base and having said lumbar pad supported on an upper end thereof, said support mechanism including an adjustment assembly cooperating with said support arm to vary the amount of support pressure applied on said opposite sides of said centerline by said left and right pad sections to the lumbar region of a chair occupant, said adjustment assembly including an actuator arrangement for independently varying the support pressure relative to said centerline for each of said pad sections wherein said support pressure of one said pad section on one said side of said centerline is independently variable relative to said support pressure provided by the other of said pad sections on the other said side of said centerline.

19. A lumbar pad assembly comprising:

a lumbar pad having left and right pad sections; and a support mechanism comprising a base adapted to be mounted to a chair, and a support arm connected to said base and having said lumbar pad supported on an upper end thereof, said support mechanism including an adjustment assembly cooperating with said support arm to vary the amount of support pressure applied by left and right halves of said pad sections to the lumbar region of a chair occupant, said adjustment assembly including an actuator arrangement for independently varying the support pressure for each of said pad sections wherein said support pressure of one said pad section is independently variable relative to said support pressure provided by the other of said pad sections, said support arm being a cantilevered leaf spring comprising left and right edge portions which independently support said pad sections.

20. The lumbar pad assembly according to claim 19, wherein said adjustment assembly varies a fulcrum point for each of said edge sections such that said edge sections selectively provide equal and asymmetric support to said pad sections.

21. A lumbar pad assembly comprising:

a lumbar pad having left and right pad sections; and a support mechanism comprising a base adapted to be mounted to a chair, and a support arm connected to said base and having said lumbar pad supported on an upper end thereof, said support mechanism including an adjustment assembly cooperating with said support arm to vary the amount of support pressure applied by left and right halves of said pad sections to the lumbar region of a chair occupant, said adjustment assembly including an actuator arrangement for independently varying the support pressure for each of said pad sections wherein said support pressure of one said pad section is independently variable relative to said support pressure provided by the other of said pad sections, said support mechanism including a height adjustment mechanism which permits a height of said lumbar pad to be adjusted vertically.

22. In a chair having a support pad arrangement adapted to support a portion of a back of a chair occupant, said chair comprising:

a back frame having a ring-like annular frame which defines an open frame region therein, said frame being defined by front and rear frame sections having exterior faces and opposite interior faces and being joined together with said interior faces being joined in opposing, abutting relation, wherein said interior faces of said frame sections are cooperatively recessed to define a pocket which opens through an inner edge of said frame into the open frame region; and the support pad arrangement comprising a support pad adapted to support a lower back region of a chair occupant, said support pad including a downwardly extending support arm having a connector end which inserts into said pocket and is fixedly engaged therewith.

23. In a chair having a support pad arrangement adapted to support a portion of a back of a chair occupant, said chair comprising:

a back frame having a ring-like annular frame which defines an open frame region therein, said frame being defined by front and rear frame sections joined together, wherein said frame sections define a pocket which opens through an inner edge of said frame into the open frame region; and the support pad arrangement comprising a support pad adapted to support a lower back region of a chair occupant, said support pad including a downwardly extending support arm having a connector end which inserts into said pocket and is fixedly engaged therewith, said connector end of said support pad including deflectable connector arms which deflect inwardly during insertion into said pocket and deflect outwardly to a normal position for fixed engagement with said pocket.

24. The chair according to claim 23, wherein said support pad is positioned proximate a pelvic region of the chair occupant.

25. In a chair comprising a back assembly for supporting the back of a chair occupant, said back assembly comprising an annular frame defining an open region therebetween and a support fabric extending across said open area and having a periphery joined to a respective periphery of said frame to define a back surface which faces forwardly for supporting the occupant's back, said chair further including a lumbar support assembly comprising a support arm connected to said back frame and projecting into said open area, said support arm having hooks on an upper end thereof, said lumbar support assembly further including a lumbar pad having engagement portions adapted to be hooked onto said hooks such that said lumbar pad is suspended downwardly and lies against said support fabric, said engagement portions being configured to be fitted onto said hooks with said lumbar pad in an upwardly tilted orientation and permit pivoting of said lumbar pad to a downwardly suspended vertical orientation wherein a lower edge of said lumbar pad hangs freely, said lumbar pad when positioned adjacent said support fabric being prevented from pivoting to said tilted orientation such that said support fabric prevents removal of said lumbar pad from said support arm.

26. In a chair comprising a seat-back assembly for supporting a chair occupant, said chair including a lumbar support arrangement mounted on a back of the chair which comprises a lumbar pad positioned on the back so as to support a lumbar region of the occupant when disposed thereon, said lumbar pad comprising left and right pad halves disposed in opposite sides of a vertical centerline of the lumbar pad and said support arrangement comprises first and second support sections which respectively support said left and right pad halves on said chair so as to permit rearward displacement of said left and right pad halves independently of and in unison with each other, said lumbar pad asymmetrically supporting the occupant's lumbar region wherein the left and right halves generate a pressure distribution over respective support surfaces thereof, and the pressure distribution provided by one of said pad halves is set to asymmetrically differ on one said side of said centerline from the pressure distribution provided by the other of the pad halves on the other said side of said centerline.

27. The chair according to claim 26, wherein said pressure distributions are selectively variable on the left and right halves to permit adjustment of the pressure distributions between symmetric levels and asymmetric levels.

28. The chair according to claim 26, wherein said chair further includes a support unit disposed on said back which has a fixed end connected to a frame of the back and a support end which is connected to said lumbar pad, said support unit including said first and second support sections to respectively support said left and right pad halves and define said variable pressure distributions.

29. The chair according to claim 26, wherein said first and second support sections include respective independent adjustment devices which are manually adjustable independent of each other to vary the respective pressure distributions between symmetric levels and asymmetric levels.

30. The chair according to claim 29, wherein said first and second support sections are defined by leaf spring sections which are separated at least along a portion of a length thereof.

31. The chair according to claim 26, wherein said lumbar pad comprises a plurality of concentric elastomeric rings which are disposed one inside of the other and have adjacent peripheral edges which are spaced from each other such that said support rings are separated from each other along a majority of the peripheral length thereof, said pad further including connector webs extending radially crosswise between adjacent rings to join each said support ring to an adjacent said support ring, each of said adjacent pairs of said support rings having a plurality of said connector webs which are peripherally spaced apart from each other.

32. The chair according to claim 31, wherein said connector webs and said lumbar pad are disposed at variable distances from said centerline to govern the pressure distribution applied by said lumbar pad to the back of a chair occupant disposed in contact therewith.

33. The chair according to claim 26, wherein said first and second support sections each resiliently resist said rearward displacement of said left and right pad halves with respective counteracting restoring forces.

34. The chair according to claim 33, which includes an adjustment mechanism which independently and differently varies said restoring forces of said first and second support sections.

35. A lumbar pad assembly for a chair comprising:

a lumbar support pad having a front support surface adapted to contact and support a lumbar region of a chair occupant's back, said lumbar pad having opposite side sections disposed on opposite sides of a vertical centerline extending across said support surface which are displaceable rearwardly both one at a time and in unison, said lumbar pad assembly being arranged to provide asymmetric support to said lumbar pad on opposite sides of said centerline to generate pressure distributions over said pad sections which are asymmetrically variable relative to said centerline to vary the pressure distributions provided by said support surface through said pad sections on said opposite sides of said centerline; and a support arrangement mounting said lumbar pad to a chair and providing variable support to said pad sections by generating a respective restoring force acting on each of said pad sections against rearward displacement, said support arrangement further including an adjustment mechanism for varying the restoring forces provided respectively by said support arrangement to said lumbar pad to independently vary the pressure distribution on one said side of said centerline relative to the pressure distribution on the other side of said centerline.

36. The lumbar pad assembly according to claim 35, wherein left and right sections of said support arrangement are defined by a cantilevered leaf spring having left and right edge portions thereof being at least partially separated along a length thereof wherein said edge portions are connected respectively to said pad sections.

37. The chair according to claim 36, wherein said first and second support sections include respective independent adjustment devices which are manually adjustable independent of each other to vary the respective pressure distributions between symmetric levels and asymmetric levels.

* * * * *